US008151770B2

(12) United States Patent
Kawashima et al.

(10) Patent No.: US 8,151,770 B2
(45) Date of Patent: Apr. 10, 2012

(54) ENGINE FUEL SUPPLY SYSTEM

(75) Inventors: Yasukuni Kawashima, Oyama (JP); Tetsuo Orita, Madison, WI (US)

(73) Assignee: Komatsu Ltd., Tokyo (JP)

( * ) Notice: Subject to any disclaimer, the term of this patent is extended or adjusted under 35 U.S.C. 154(b) by 91 days.

(21) Appl. No.: 12/678,863

(22) PCT Filed: Sep. 10, 2008

(86) PCT No.: PCT/JP2008/066324

§ 371 (c)(1),
(2), (4) Date: Mar. 18, 2010

(87) PCT Pub. No.: WO2009/038003

PCT Pub. Date: Mar. 26, 2009

(65) Prior Publication Data

US 2010/0212641 A1 Aug. 26, 2010

(30) Foreign Application Priority Data

Sep. 21, 2007 (JP) ..... 2007-245148

(51) Int. Cl.
*F02M 23/00* (2006.01)

(52) U.S. Cl. ..... 123/532; 123/516; 60/286

(58) Field of Classification Search ..... 123/506, 123/508, 511, 514–516, 522, 525, 527, 27 GE, 123/532, 533, 534; 60/286, 274, 295, 297, 60/301, 303

See application file for complete search history.

(56) References Cited

U.S. PATENT DOCUMENTS

| | | | | |
|---|---|---|---|---|
| 4,207,033 | A * | 6/1980 | Drutchas et al. | 417/251 |
| 4,925,372 | A * | 5/1990 | Hansen | 417/310 |
| 5,051,065 | A * | 9/1991 | Hansen | 417/201 |
| 5,450,832 | A * | 9/1995 | Graf | 123/515 |
| 2005/0247048 | A1 | 11/2005 | Schaller et al. | 60/286 |

FOREIGN PATENT DOCUMENTS

| | | |
|---|---|---|
| GB | 1195318 | 6/1970 |
| JP | 2-256869 | 10/1990 |
| JP | 5-34486 | 5/1993 |
| JP | 6-93833 | 4/1994 |

(Continued)

OTHER PUBLICATIONS

Extended European Search report dated Sep. 3, 2010.

(Continued)

*Primary Examiner* — John Kwon
(74) *Attorney, Agent, or Firm* — Kratz, Quintos & Hanson, LLP

(57) ABSTRACT

An engine fuel supply system is provided at a reduced cost by using a HC dosing pump that supplies fuel into an exhaust pipe also as a pump for a cylinder fuel supply device. When a signal is generated to command air removal from a cylinder fuel supply passage, the dual-purpose pump is activated, a first on-off valve assumes an open state, and a second on-off valve assumes a close state, so that the fuel is supplied from the dual-purpose pump to the cylinder fuel supply passage via an air-removal fuel supply passage. When a signal is generated to command fuel supply into the exhaust pipe, the dual-purpose pump is activated, the second on-off valve assumes the open state, and the first on-off valve assumes the close state, so that the fuel is supplied from the dual-purpose pump to the exhaust pipe via the exhaust-pipe fuel supply passage.

9 Claims, 10 Drawing Sheets

FOREIGN PATENT DOCUMENTS

| | | |
|---|---|---|
| JP | 6-40363 | 5/1994 |
| JP | 8-68315 | 3/1996 |
| JP | 8-284647 | 10/1996 |
| JP | 2000-193824 | 7/2000 |

OTHER PUBLICATIONS

International Search Report for International Application No. PCT/JP2008/066324 dated Dec. 2, 2008.

* cited by examiner

ENGINE FUEL SUPPLY SYSTEM

TECHNICAL FIELD

This invention relates to an engine fuel supply system, and particularly to an engine fuel supply system which removes air from a cylinder fuel supply passage and supplies fuel into an exhaust pipe.

BACKGROUND ART

1. Related Conventional Arts

FIGS. 10A and 10B show engine fuel supply systems 100 according to related conventional arts, respectively.

FIG. 10A shows a cylinder fuel supply device 110 for supplying fuel into a cylinder of an engine 2 via a feed pump 1. FIG. 10B shows an HC (hydrocarbon) dosing device 120 for supplying fuel to an exhaust pipe 4 of an engine 2.

In the cylinder fuel supply device 110 shown in FIG. 10A, fuel in a fuel tank 5 is sucked by the feed pump 1 via a supply passage 10*a*, a pre-filter 6, and a supply passage 10*b*. The feed pump 1 discharges the fuel to a supply passage 10*c* after raising the pressure of the fuel to a predetermined fuel pressure, for example to about 3 to 5 kgf/cm$^2$. The fuel the pressure of which has been raised by the feed pump 1 is sucked into a supply pump 8 via the supply passage 10*c*, a main filter 7, and a supply passage 10*d*. The supply pump 8 discharges the fuel to a supply passage 10*e* after further raising the pressure of the fuel to a predetermined fuel pressure, for example to about 1000 to 1600 kgf/cm$^2$. The fuel the pressure of which has been raised by the supply pump 8 is supplied into a cylinder of the engine 2 via the supply passage 10*e* by a common rail and an injector (not shown). The engine 2 is operated by the high-pressure fuel being injected into the cylinder of the engine 2. If the fuel overflows in the supply pump 8, the excess fuel is discharged to the fuel tank 5 via an overflow fuel discharge passage 11.

When so-called "running out of gas" occurs, in other words, when the fuel in the fuel tank 5 has run short during operation of the engine 2 and the fuel supply to the engine 2 is stopped, or when the pre-filter 6 or the main filter 7 is replaced, air may be entrapped in a cylinder fuel supply passage 10. If air is entrapped in the cylinder fuel supply passage 10, the pressure of fuel flowing through the cylinder fuel supply passage 10 will not be raised to an adequate level for a long period of time until the air is completely removed from the cylinder fuel supply passage 10, leading to malfunction of the engine 2 or even difficulty in starting the engine. Therefore, a priming pump 9 need be activated periodically, every time after the fuel filter is replaced, for example every time the engine 2 has operated for 500 hours, or when running out of gas occurs, in order to remove the air before the engine 2 is operated.

Upon a switch 12 being turned on, a relay 13 is energized and the priming pump 9 is activated. Since air removal must be performed in the state where the engine 2 is not in operation, the priming pump 9 is activated while the engine 2 is not in operation.

Upon the priming pump 9 being activated, fuel in the fuel tank 5 is sucked into a suction port 9*b* of the priming pump 9 via the supply passage 10*a*, the pre-filter 6, the supply passage 10*b*, and a fuel suction passage 30. The priming pump 9 raises the pressure of the fuel to a predetermined fuel pressure suitable for air removal, for example to about 3 to 5 kgf/cm$^2$, and discharges the fuel into an air-removal fuel supply passage 31 through a discharge port 9*a*. The fuel the pressure of which has been raised by the priming pump 9 is fed under pressure to the main filter 7 via the air-removal fuel supply passage 31, passes through the supply pump 8, and is discharged into the fuel tank 5 via the overflow fuel discharge passage 11. On the other hand, the fuel the pressure of which has been raised by the priming pump 9 is fed under pressure to the main filter 7 via the air-removal fuel supply passage 31, and is discharged into the fuel tank 5 via an air-removal fuel discharge passage 32. This removes air from the inside of the cylinder fuel supply passage 10.

Next, the HC dosing device 120 shown in FIG. 10B will be described.

Due to recent tighter regulations on exhaust gas of the engine 2, a diesel particulate filter 14 serving as an exhaust gas aftertreatment device is provided within the exhaust pipe 4. The diesel particulate filter 14 collects particulate matter (PM) contained in exhaust gas from the engine 2, whereby atmospheric diffusion of the particulate matter is restrained.

However, as the diesel particulate filter 14 is used for a long time to collect the particulate matter PM, the pressure loss in the exhaust pipe 4 will be increased, leading to difficulty in discharge of exhaust gas, and the filter will be clogged, resulting in deterioration of the function of the diesel particulate filter 14. Accordingly, the particulate matter PM deposited in the diesel particulate filter 14 must be removed to recover the function of the diesel particulate filter 14 at regular intervals, for example every time the engine 2 has operated for several tens of hours. Such recovery of the diesel particulate filter 14 can be performed by various methods, including "HC dosing" method.

It is well known that in order to remove the particulate matter PM deposited in the diesel particulate filter 14, the temperature of the exhaust gas is increased to burn soot in the particulate matter PM clogging the filter. For this purpose, an oxidation catalyst 15 is disposed before the diesel particulate filter 14 in the exhaust pipe 4, and the fuel is sprayed to the oxidation catalyst 15 so that oxidation reaction occurs between HC (hydrocarbon) in the fuel and the oxidation catalyst 15 to generate heat and thus to raise the temperature of the exhaust gas.

The HC dosing device 120 is provided for supplying fuel into the exhaust pipe 4 for the purpose of recovering the function of the diesel particulate filter 14.

A controller 50 is provided to determine it is time to recover the function of the exhaust gas aftertreatment device (hereafter, referred to simply as the "recovery time") on the basis of a detection signal from a sensor 51, and upon determining so, applies a signal to command fuel supply into the exhaust pipe 4 to the HC dosing pump 16 and valves 17 and 19. As the HC dosing pump 16 is thus activated, the valves 17 and 19 are opened. Since the fuel supply into the exhaust pipe 4 must be performed in the state where the engine 2 is in operation and the exhaust gas is discharged, the HC dosing pump 16 is activated while the engine 2 is in operation.

Upon the HC dosing pump 16 being activated, the fuel in the fuel tank 5 is sucked into a suction port 16*b* of the HC dosing pump 16 via a fuel suction passage 41.

The HC dosing pump 16 raises the pressure of the fuel to a predetermined fuel pressure suitable for supply into the exhaust pipe, for example to about 7 to 10 kgf/cm$^2$, and then discharges the fuel to a passage 20*a* through a discharge port 16*a*. The fuel the pressure of which has been raised by the HC dosing pump 16 is injected and supplied into the exhaust pipe 4 via the supply passage 20*a*, the second on-off valve 17, a flow control valve 19, a supply passage 20*b*, and a nozzle 21.

2. Prior Related Arts Described in Patent Documents

Patent Document 1 listed below discloses an invention wherein a pump exclusively for air removal is provided in addition to a feed pump so that air removal from a fuel system of a diesel engine is performed by operating this pump.

Inventions relating to the above-described HC dosing device are disclosed in Patent Documents 2 and 3 listed below.

Further, a technique for supplying fuel to an exhaust pipe in the same manner as the above-described HC dosing device is found in Patent Document 4 listed below. This Patent Document 4 discloses an invention wherein an exhaust pipe is provided with a catalyst for removing NOx contained in exhaust gas, and light oil fuel serving as a reducing agent with respect to the catalyst is injected under high pressure into the exhaust pipe in order to enhance the NOx removal efficiency of the catalyst.

Patent Document 1: JP H2-256869A
Patent Document 2: JP H5-34486A
Patent Document 3: JP 2000-193824A
Patent Document 4: JP H8-68315A

DISCLOSURE OF THE INVENTION

Problems to be Solved by the Invention

As described above, the HC dosing device 120 is provided independently from the cylinder fuel supply device 110, and the HC dosing pump 16 must be provided exclusively for the HC dosing device 120 in addition to the various pumps 1, 8, 9 used in the cylinder fuel supply device 110.

This invention has been made in view of these circumstances, and it is an object of the invention to reduce the system cost by using a pump used in the cylinder fuel supply device 110 also as a HC dosing pump or other pump for supplying fuel into an exhaust pipe.

Means for Solving the Problems

A first aspect of the invention relates to an engine fuel supply system having a cylinder fuel supply passage for supplying fuel into an engine cylinder by a fuel pump, and an exhaust-pipe fuel supply passage for supplying fuel into an engine exhaust pipe, and the engine fuel supply system is characterized by including:

a dual-purpose pump provided separately from the fuel pump to serve both for air removal from the cylinder fuel supply passage and for fuel supply into the exhaust pipe;

an air-removal fuel supply passage that communicates a discharge port of the dual-purpose pump with the cylinder fuel supply passage;

the exhaust-pipe fuel supply passage that communicates the discharge port of the dual-purpose pump with the exhaust pipe;

a first on-off valve provided on the air-removal fuel supply passage for opening/closing the air-removal fuel supply passage;

a second on-off valve provided on the exhaust-pipe fuel supply passage for opening/closing the exhaust-pipe fuel supply passage; and control means which, when a signal is generated to command air removal from the cylinder fuel supply passage, activates the dual-purpose pump, causes the first on-off valve to assume the open state, and causes the second on-off valve to assume the close state, so that the fuel is supplied from the dual-purpose pump to the cylinder fuel supply passage via the air-removal fuel supply passage, and which, when a signal is generated to command fuel supply into the exhaust pipe, activates the dual-purpose pump, causes the second on-off valve to assume the open state, and causes the first on-off valve to assume the close state, so that the fuel is supplied from the dual-purpose pump to the exhaust pipe via the exhaust-pipe fuel supply passage.

A second aspect of the invention is characterized by including:

a first fuel suction passage that communicates a supply passage on a suction port side of the fuel pump in the cylinder fuel supply passage with a suction port of the dual-purpose pump;

a second fuel suction passage that communicates a supply passage on a discharge port side of the fuel pump in the cylinder fuel supply passage with the suction port of the dual-purpose pump;

a first suction on-off valve provided on the first fuel suction passage for opening/closing the first fuel suction passage;

a second suction on-off valve provided on the second fuel suction passage for opening/closing the second fuel suction passage; and control means which, when the signal is generated to command air removal from the cylinder fuel supply passage, causes the first suction on-off valve to assume the open state, and causes the second suction on-off valve to assume the close state, so that the fuel is sucked into the suction port of the dual-purpose pump from the suction port side of the fuel pump via the first fuel suction passage, and which, when the signal is generated to command fuel supply into the exhaust pipe, causes the second suction on-off valve to assume the open state, and causes the first suction on-off valve to assume the close state, so that the fuel is sucked into the suction port of the dual-purpose pump from the discharge port side of the fuel pump via the second fuel suction passage.

A third aspect of the invention according to the first aspect is characterized in that the first on-off valve is opened/closed by a fuel pressure signal.

A fourth aspect of the invention according to the second aspect is characterized in that the first on-off valve, the first suction on-off valve, and the second suction on-off valve are opened/closed by a fuel pressure signal.

A fifth aspect of the invention according to the first aspect is characterized in that the first on-off valve is opened/closed by an electrical signal.

A sixth aspect of the invention according to the second aspect is characterized in that the first on-off valve, the first suction on-off valve, and the second suction on-off valve are opened/closed by an electrical signal.

A seventh aspect of the invention relates to an engine fuel supply system characterized by including:

a dual-purpose pump serving both for air removal from the cylinder fuel supply passage and for fuel supply into the exhaust pipe; and control means which inhibits fuel supply from the dual-purpose pump into the exhaust pipe during air removal, and inhibits fuel supply from the dual-purpose pump to the cylinder fuel supply passage during fuel supply to the exhaust pipe.

In the first aspect of the invention, as shown in FIG. 1, an engine fuel supply system 100 has a cylinder fuel supply passage 10 for supplying fuel into a cylinder of an engine 2 via a fuel pump (feed pump) 1 and an exhaust-pipe fuel supply passage 20 for supplying fuel into an exhaust pipe 4 of the engine 2.

A dual-purpose pump 60 is provided separately from the fuel pump 1, and serves both for air removal from the cylinder fuel supply passage 10 and for fuel supply into the exhaust pipe 4.

A discharge port 60*a* of the dual-purpose pump 60 is communicated with the cylinder fuel supply passage 10 by an air-removal fuel supply passage 70.

The discharge port 60*a* of the dual-purpose pump 60 is communicated with the exhaust pipe 4 by the exhaust-pipe fuel supply passage 20.

A first on-off valve 71 is provided on the air-removal fuel supply passage 70, so that the first on-off valve 71 opens and closes the air-removal fuel supply passage 70.

A second on-off valve 17 is provided on the exhaust-pipe fuel supply passage 20, so that the second on-off valve 17 opens and closes the exhaust-pipe fuel supply passage 20.

When a signal is generated to command air removal from the cylinder fuel supply passage 10, control means 50 activates the dual-purpose pump 60, causes the first on-off valve 71 to assume the open state, and causes the second on-off valve 17 to assume the close state, so that the fuel is supplied from the dual-purpose pump 60 to the cylinder fuel supply passage 10 via the air-removal fuel supply passage 70. When a signal is generated to command fuel supply into the exhaust pipe 4, the control means 50 activates the dual-purpose pump 60, causes the second on-off valve 17 to assume the open state, and causes the first on-off valve 71 to assume the close state, so that the fuel is supplied from the dual-purpose pump 60 to the exhaust pipe 4 via the exhaust-pipe fuel supply passage 20.

According to the first aspect of the invention, the system cost can be reduced, since both the air removal from the cylinder fuel supply passage 10 and the fuel supply into the exhaust pipe 4 can be performed by using the dual-purpose pump 60. According to the second aspect of the invention, as shown in FIG. 5, a supply passage 10*b* on a suction port 1*b* side of the fuel pump (feed pump) 1 in the cylinder fuel supply passage 10 is communicated with the suction port 60*b* of the dual-purpose pump 60 by a first fuel suction passage 80.

A supply passage 10*c* on a discharge port 1*a* side of the fuel pump 1 in the cylinder fuel supply passage 10 is communicated with the suction port 60*b* of the dual-purpose pump 60 by a second fuel suction passage 81.

A first suction on-off valve 82 is provided on the first fuel suction passage 80 for opening/closing the first fuel suction passage 80.

A second suction on-off valve 83 is provided on the second fuel suction passage 81 for opening/closing the second fuel suction passage 81.

When a signal is generated to command air removal from the cylinder fuel supply passage 10, the control means 50 causes the first suction on-off valve 82 to assume the open state, and causes the second suction on-off valve 83 to assume the close state, so that the fuel is sucked into the suction port 60*b* of the dual-purpose pump 60 from the suction port 1*b* side of the fuel pump 1 via the first fuel suction passage 80. Further, when a signal is generated to command fuel supply into the exhaust pipe 4, the control means 50 causes the second suction on-off valve 83 to assume the open state, and causes the first suction on-off valve 82 to assume the close state, so that the fuel is sucked into the suction port 60*b* of the dual-purpose pump 60 from the discharge port 1*a* side of the fuel pump 1 via the second fuel suction passage 81.

According to the second aspect of the invention, when the fuel is to be supplied into the exhaust pipe 4, the fuel is sucked from the discharge port 1*a* side of the fuel pump 1 into dual-purpose pump 60, where the pressure of the fuel is raised to a fuel pressure suitable for supplying the fuel into the exhaust pipe 4.

When the fuel is supplied to the exhaust pipe 4, the engine 2 is in operation and the fuel pump (feed pump) 1 has been activated. The dual-purpose pump 60 is only required to further raise the pressure of the fuel that has already been raised by the fuel pump 1 up to a predetermined pressure (about 3 to 5 kgf/cm$^2$), up to a pressure suitable for supplying the fuel into the exhaust pipe 4 (about 7 to 10 kgf/cm$^2$). Accordingly, the pressure raising capacity required of the dual-purpose pump 60 can be lower than the case of raising the fuel pressure which has not been raised previously.

On the other hand, air removal from the cylinder fuel supply passage 10 is performed principally when the engine 2 is not in operation. According to the second aspect of the invention, the fuel in the fuel tank 5 is sucked into the dual-purpose pump 60 from the suction port 1*b* side of the fuel pump 1 when air removal from the cylinder fuel supply passage 10 is performed. Therefore, the fuel in the fuel tank 5 can be sucked from the suction port 1*b* side of the fuel pump 1 effectively even when the engine 2 is not in operation and the fuel pump 1 has not been activated. The fuel pressure (of about 4 kgf/cm$^2$) obtained by raising the pressure of the fuel in the fuel tank 5 (an atmospheric pressure) by means of the dual-purpose pump 60 is lower than the fuel pressure (of about 7 to 9 kgf/cm$^2$) obtained by further raising the fuel pressure that has previously been raised up to a predetermined pressure (of about 3 to 5 kgf/cm$^2$) by the operation of the fuel pump 1. However, since the air removal from the cylinder fuel supply passage 10 can be performed under a lower fuel pressure than the pressure required for supplying the fuel into the exhaust pipe 4, the air removal from the cylinder fuel supply passage 10 can be performed satisfactorily.

According to the second aspect of the invention, the pressure raising capacity required of the dual-purpose pump 60 can be reduced, and hence the size of the dual-purpose pump 60 can be reduced.

According to the third aspect of the invention, the first on-off valve 71 is opened/closed by a fuel pressure signal.

According to the fourth aspect of the invention, the first on-off valve 71, the first suction on-off valve 82, and the second suction on-off valve 83 are opened/closed by a fuel pressure signal.

According to the fifth aspect of the invention, the first on-off valve 71 is opened/closed by an electrical signal.

According to the sixth aspect of the invention, the first on-off valve 71, the first suction on-off valve 82, and the second suction on-off valve 83 are opened/closed by an electrical signal.

As described in relation to the first aspect of the invention, the dual-purpose pump 60 is used both for air removal from the cylinder fuel supply passage 10 and for fuel supply to the exhaust pipe 4, and the control means 50 operates to inhibit the fuel supply from the dual-purpose pump 60 to the exhaust pipe 4 during air removal, whereas when the fuel is to be supplied into the exhaust pipe 4, the control means 50 operates to inhibit the fuel supply from the dual-purpose pump 60 to the cylinder fuel supply passage 10 (seventh aspect of the invention).

BEST MODE FOR CARRYING OUT THE INVENTION

Referring to the accompanying drawings, exemplary embodiments of an engine fuel supply system according to this invention will be described.

Figure 1:
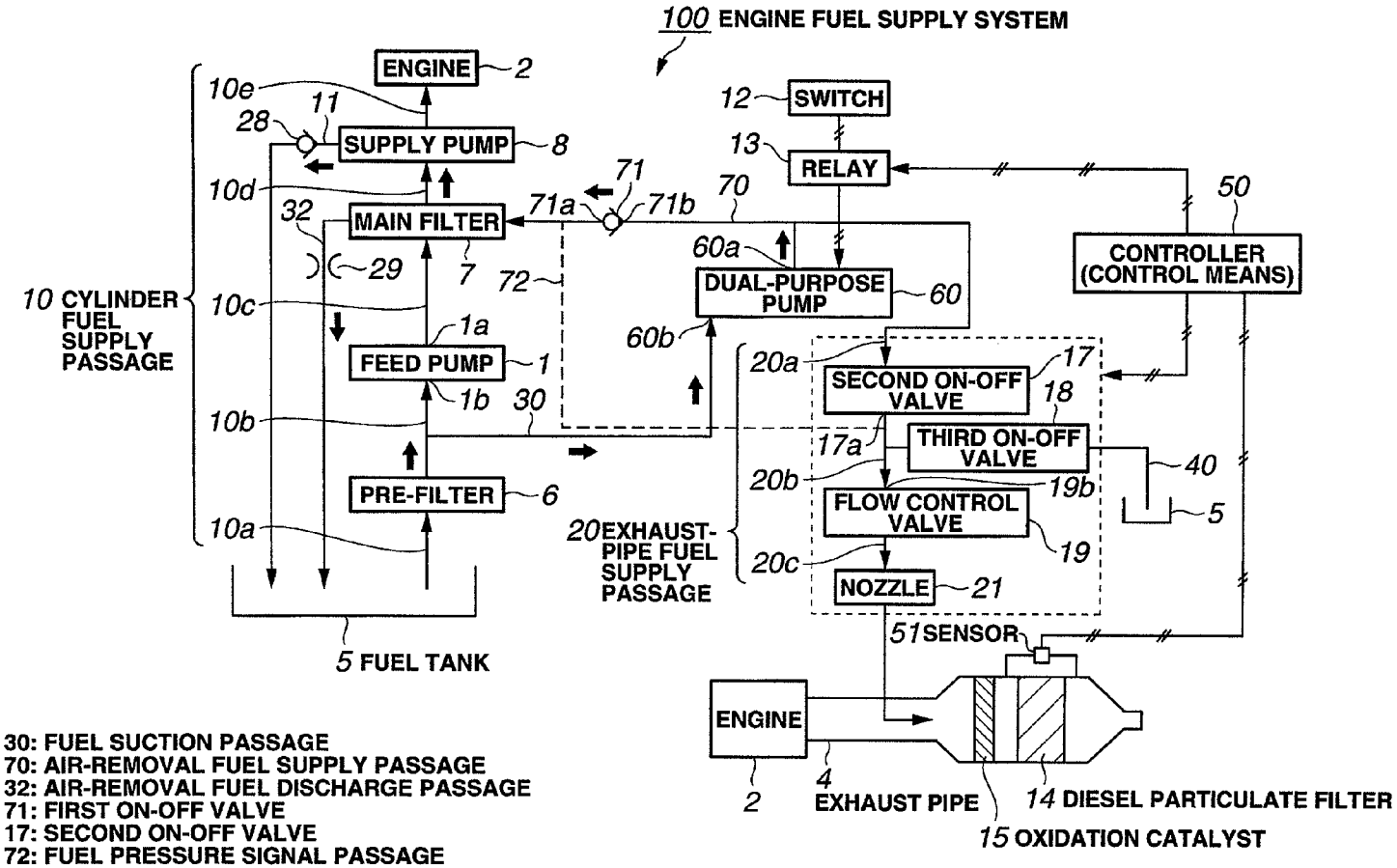
FIG. 1 is a configuration diagram showing an engine fuel supply system according to an embodiment of the invention, and is a diagram for explaining operation to perform air removal while the engine is not in operation.

FIG. 1 is a configuration diagram of an engine fuel supply system 100 according to an exemplary embodiment.

As shown in FIG. 1, the engine fuel supply system 100 according to the embodiment includes a cylinder fuel supply passage 10 for supplying fuel into a cylinder of an engine 2 via a feed pump 1, and an exhaust-pipe fuel supply passage 20 for supplying fuel to an exhaust pipe 4 of the engine 2.

The cylinder fuel supply passage 10 communicates a fuel tank 5 with the inside of the cylinder of the engine 2. There are disposed, in the cylinder fuel supply passage 10, the fuel tank 5, a pre-filter 6, a feed pump 1, a main filter 7, a supply pump 8, and the engine 2. The engine 2 is a diesel engine.

The feed pump 1 and the supply pump 8 together form a fuel pump. The pre-filter 6 is a fuel filter including a water separator, and is provided for separating and collecting water mixed in fuel as well as for collecting contaminants in the fuel. The main filter 7 is a fuel filter provided for collecting contaminants in the fuel.

The cylinder fuel supply passage 10 comprises supply passages 10*a*, 10*b*, 10*c*, 10*d*, and 10*e*. The fuel tank 5 is communicated with the pre-filter 6 by the supply passage 10*a*, the pre-filter 6 is communicated with the feed pump 1 by the supply passage 10*b*, the feed pump 1 is communicated with the main filter 7 by the supply passage 10*c*, the main filter 7 is communicated with the supply pump 8 by the supply passage 10*d*, and the supply pump 8 is communicated with the engine 2 by the supply passage 10*e*. The supply pump 8 is communicated with the fuel tank 5 by an overflow fuel discharge passage 11. The overflow fuel discharge passage 11 is provided with a check valve 28 which allows only flow of the fuel flowing from the supply pump 8 to the fuel tank 5.

A dual-purpose pump 60 is provided separately from the feed pump 1. The dual-purpose pump 60 serves both for air removal from the cylinder fuel supply passage 10 and for fuel supply, namely HC dosing into the exhaust pipe 4.

The dual-purpose pump 60 is formed by a motor pump. A switch 12 is electrically connected to a relay 13 and the dual-purpose pump 60. The dual-purpose pump 60 is activated by energization of the relay 13. When the switch 12 is turned on to command air removal from the cylinder fuel supply passage 10, a signal is generated to command air removal from the cylinder fuel supply passage 10. This signal is applied to the relay 13 and the relay 13 is energized. The energization of the relay 13 activates the dual-purpose pump 6.

The air removal is performed by means of the fuel suction passage 30, an air-removal fuel supply passage 70, an air-removal fuel discharge passage 32, and the overflow fuel discharge passage 11.

The supply passage 10*b* is communicated with a suction port 60*b* of the dual-purpose pump 60 by the fuel suction passage 30. A discharge port 60*a* of the dual-purpose pump 60 is communicated with the main filter 7 in the cylinder fuel supply passage 10 by the air-removal fuel supply passage 70. A first on-off valve 71 is provided on the air-removal fuel supply passage 70, and the first on-off valve 71 opens/closes the air-removal fuel supply passage 70. The first on-off valve 71 is formed by a check valve which allows only flow of the fuel flowing from the dual-purpose pump 60 to the main filter 7. It should be noted that although, in this embodiment, the air-removal fuel supply passage 70 communicates the discharge port 60*a* of the dual-purpose pump 60 with the main filter 7 in the cylinder fuel supply passage 10, the air-removal fuel supply passage 70 may communicate the discharge port 60*a* of the dual-purpose pump 60 with the supply passage 10*c* of the cylinder fuel supply passage 10. The air-removal fuel supply passage 70 may communicate the discharge port 60*a* of the dual-purpose pump 60 with the supply passage 10*d* of the cylinder fuel supply passage 10.

The main filter 7 is communicated with the fuel tank 5 by the air-removal fuel discharge passage 32. The air-removal fuel discharge passage 32 is provided with a orifice 29.

The fuel in the fuel tank 5 is sucked into the feed pump 1 via the supply passage 10*a*, the pre-filter 6, and the supply passage 10*b*. The feed pump 1 discharges the fuel to the supply passage 10*c* after raising the pressure of the fuel to a predetermined fuel pressure, for example to about 3 to 5 kgf/cm$^2$. The fuel the pressure of which has been raised by the feed pump 1 is sucked into the supply pump 8 via the supply passage 10*c*, the main filter 7, and the supply passage 10*d*. The supply pump 8 discharges the fuel to the supply passage 10*e* after further raising the pressure of the fuel to a predetermined fuel pressure, for example to about 1000 to 1600 kgf/cm$^2$. The fuel the pressure of which has been raised by the supply pump 8 is supplied into a cylinder of the engine 2 through the supply passage 10*e* by a common rail and an injector (not shown). The engine 2 is operated by the high-pressure fuel being injected into the cylinder of the engine 2. If any fuel overflows in the supply pump 8, the overflowing fuel is discharged to the fuel tank 5 via the overflow fuel discharge passage 11.

There is provided, in the exhaust pipe 4 of the engine 2, a diesel particulate filter 14 serving as an exhaust gas aftertreatment device. The diesel particulate filter 14 collects particulate matter (PM) contained in exhaust gas from the engine 2, whereby diffusion of PM to the atmosphere can be suppressed.

An oxidation catalyst 15 is disposed before the diesel particulate filter 14 in the exhaust pipe 4. Spraying the fuel to the oxidation catalyst 15 (HC dosing) causes oxidation reaction between HC (hydrocarbon) in the fuel and the oxidation catalyst 15, whereby heat is generated and the temperature of the exhaust gas is raised. When the temperature of the exhaust gas is raised, soot in the particulate matter PM clogged in the filter of the diesel particulate filter 14 is burned, and thus the function of the diesel particulate filter 14 is recovered.

The exhaust-pipe fuel supply passage 20 is provided to recover the function of the diesel particulate filter 14 by supplying fuel into the exhaust pipe 4 (HC dosing).

The exhaust-pipe fuel supply passage 20 communicates the dual-purpose pump 60 with the exhaust pipe 4.

There are provided, in the exhaust-pipe fuel supply passage 20, the dual-purpose pump 60, a second on-off valve 17, a third on-off valve 18, a flow control valve 19, and a nozzle 21.

The exhaust-pipe fuel supply passage 20 comprises supply passages 20*a*, 20*b*, and 20*c*.

The discharge port 60*a* of the dual-purpose pump 60 is communicated with the second on-off valve 17 by the supply passage 20*a*. The second on-off valve 17 opens/closes the exhaust-pipe fuel supply passage 20 in response to an electrical command signal given by the controller 50.

An outlet 17*a* of the second on-off valve 17 is communicated with the third on-off valve 18 and an inlet 19*b* of the flow control valve 19 by the supply passage 20*b*. The flow control valve 19 and the nozzle 21 are communicated with each other by the supply passage 20*c*. The nozzle 21 is coupled to the exhaust pipe 4 to inject fuel into the exhaust pipe 4. The nozzle 21 is disposed between the oxidation catalyst 15 and an exhaust manifold (not shown). The nozzle 21 may be coupled to the exhaust manifold.

The third on-off valve 18 and the fuel tank 5 are communicated with each other by the fuel discharge passage 40. If any fuel overflows in the third on-off valve 18, the overflowing fuel is discharged to the fuel tank 5 via the fuel discharge passage 40.

In order to cause oxidation reaction between HC and the oxidation catalyst 15 by spraying the fuel under high pressure to the oxidation catalyst 15 and thereby accelerating atomization of the fuel, the fuel must be discharged, during the HC dosing, from the dual-purpose pump 60 under a higher fuel pressure than the fuel pressure required for air removal (about 3 to 5 kgf/cm$^2$), for example under a fuel pressure of about 7 to 10 kgf/cm$^2$.

Each of the valves 17, 18, and 19 is formed by an electromagnetic valve.

The dual-purpose pump 60, the valves 17, 18, 19 and the controller 50 are electrically connected to each other. The controller 50 is electrically connected to the relay 13. The electrical command signal to be given by the controller 50 to the valves 17, 18, and 19 is off when the engine 2 is not in operation, whereby the valves 17, 18, and 19 are closed and the electrical command signal to be given by the controller 50 to the relay 13 to energize the relay 13 is off.

The exhaust pipe 4 is provided with a sensor 51 for detecting a pressure of exhaust gas in the exhaust pipe 4 from the engine 2, or a difference in pressure before and after the diesel particulate filter 14. A detection signal from the sensor 51 is input to the controller 50. The controller 50 determines whether or not the recovery time has come based on the detection signal from the sensor 51.

An outlet 71*a* of the first on-off valve 71 formed by a check valve is communicated with the supply passage 20*b* coupled to the outlet 17*a* of the second on-off valve 17 via a fuel pressure signal passage 72.

In the description below, a pressure is represented by a gauge pressure. The description will be made on the assumption that a cracking pressure of the first on-off valve 71 is set to 2 kgf/cm$^2$, a discharge pressure of the feed pump 1 is 3 kgf/cm$^2$, and a discharge pressure of the dual-purpose pump 60 is 7 kgf/cm$^2$. It should be noted that these pressure values are provided only as examples for making the description simple, and this invention is not limited to these values.

Figure 9A:
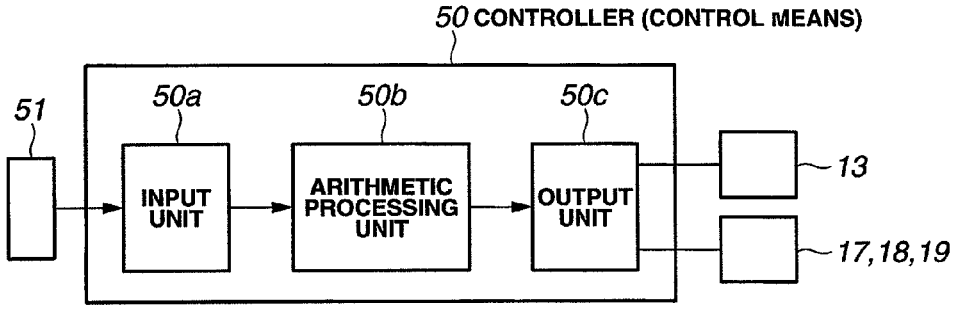
FIG. 9A is a functional block diagram of a controller.
Figure 9B:
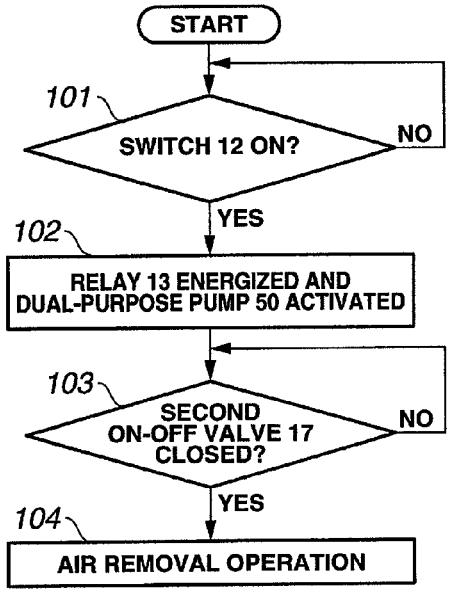
FIGS. 9B and 9C are flowcharts for explaining operation of the embodiment shown in FIGS. 1, 2, and 3, FIG. 9B showing processing that relates to manipulation of a switch, FIG. 9C showing processing performed by the controller.
Figure 9C:
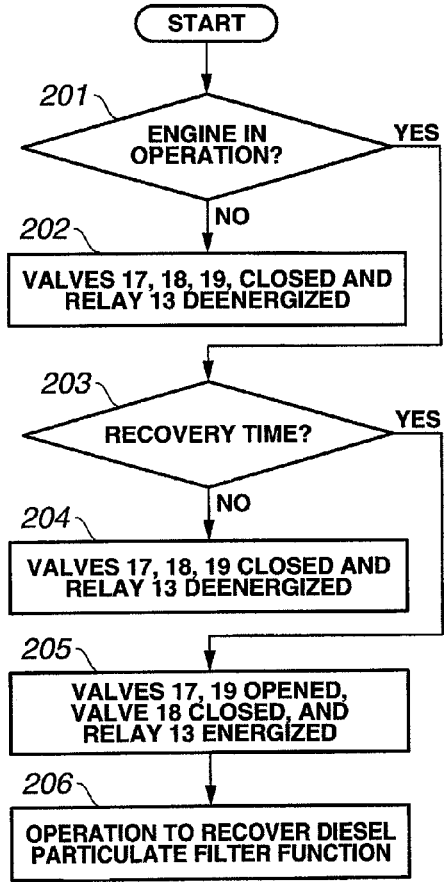
Figure 10A:
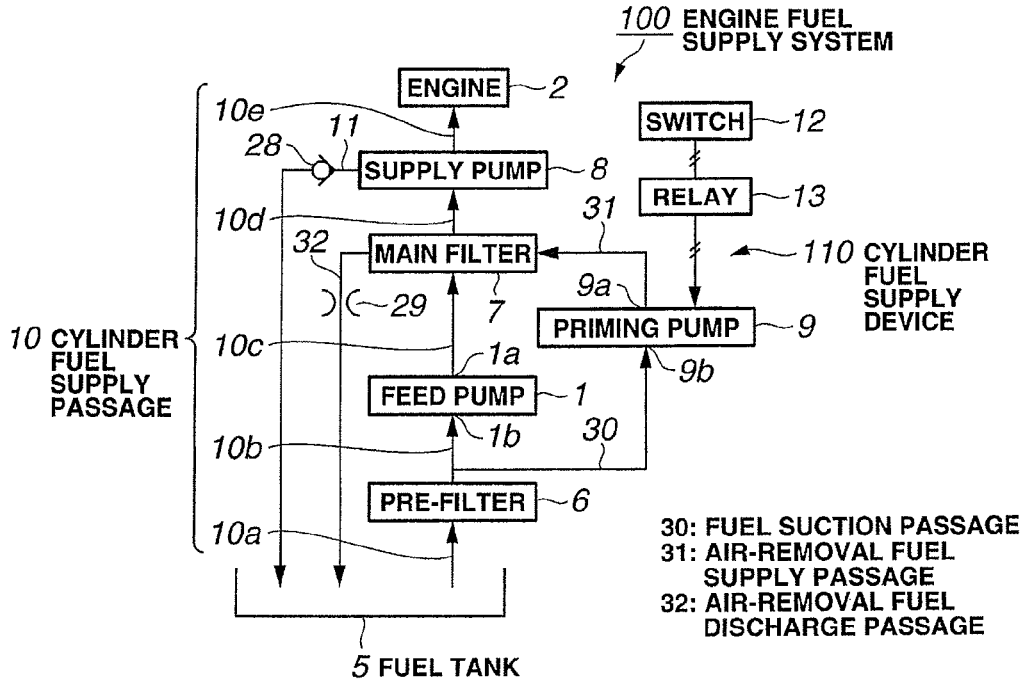
PRIOR ART FIG.10A
FIGS. 10A and 10B are configuration diagrams showing prior art systems.
Figure 10B:
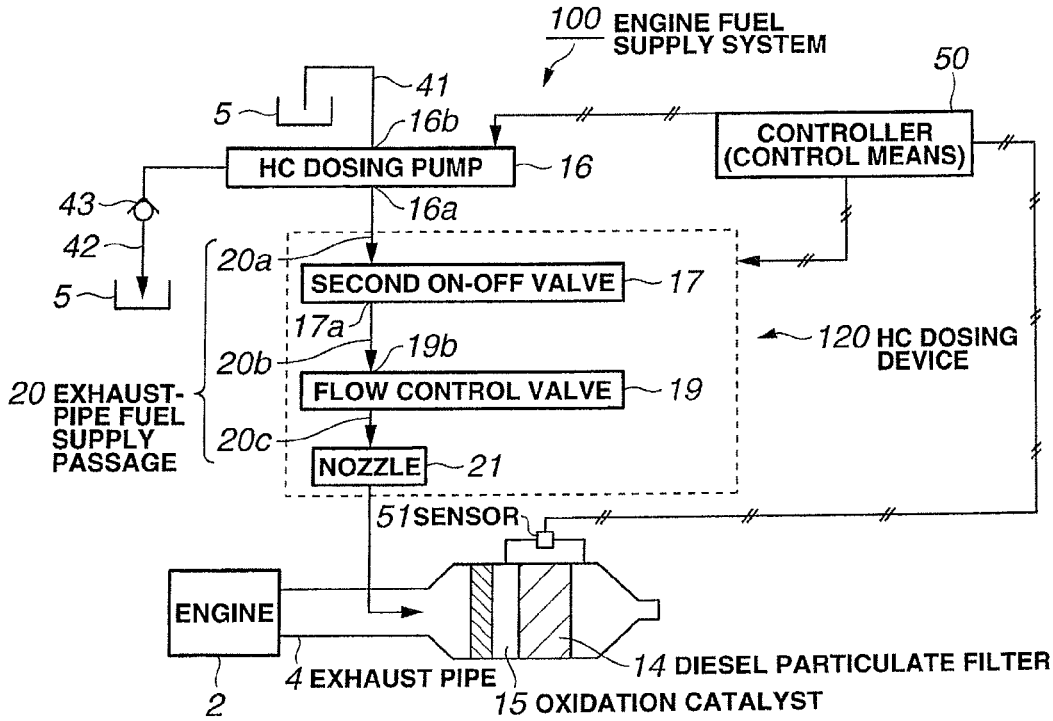
PRIOR ART FIG.10B

FIG. 9 A is a functional block diagram of the controller 50. FIGS. 9B and 9C are flowcharts for explaining operation of the embodiment shown in FIGS. 1, 2, and 3. FIG. 9B shows processing involved in manipulation of the switch 12, and FIG. 9C shows processing performed by the controller 50.

The operation of the embodiment shown in FIGS. 1, 2, and 3 will be described, additionally referring to FIGS. 9A, 9B, and 9C. Black arrows in FIGS. 1, 2, and 3 indicate flowing directions of the fuel. This also applies to an embodiment shown in FIGS. 4, 5, 6, 7, and 8.

Operation During Air Removal (FIG. 1):

Air may be entrapped in the cylinder fuel supply passage 10 when the fuel in the fuel tank 5 has run out during operation of the engine 2 and the fuel cannot be supplied to the engine 2, namely in the state of so-called "running out of gas," or when the pre-filter 6 or the main filter 7 is replaced. If air is entrapped in the cylinder fuel supply passage 10, the pressure of the fuel flowing through the cylinder fuel supply passage 10 will not be raised to an appropriate level for a long period of time until the cylinder fuel supply passage 10 is completely removed of air, leading in malfunction of the engine 2 or even difficulty in starting the engine. Therefore, before operation of the engine 2, air removal must be performed at regular intervals every time the fuel filter is replaced, for example every time the engine 2 has operated for 500 hours, or when the state of "out of gas" has occurred.

The operator turns the switch 12 on to perform air removal before starting the engine 2, that is, when the engine 2 is not in operation (determined YES in step 101 in FIG. 9B).

Upon the switch 12 being turned on, a signal is generated to command air removal from the cylinder fuel supply passage 10 and the relay 13 is energized. The energization of the relay 13 activates the dual-purpose pump 60. Upon the dual-purpose pump 60 being activated, the fuel in the fuel tank 5 is sucked into the suction port 60*b* of the dual-purpose pump 60 via the supply passage 10*a*, the pre-filter 6, the supply passage 10*b*, and the fuel suction passage 30. The dual-purpose pump 60 raises the pressure of the fuel up to 7 kgf/cm$^2$, and discharges the fuel to the air-removal fuel supply passage 70 from the discharge port 60*a*. The dual-purpose pump 60 is activated in this manner while the engine 2 is not in operation. The pressure of 7 kgf/cm$^2$ of the fuel discharged from the dual-purpose pump 60 acts on the inlet 71*b* of the first on-off valve 71 in the air-removal fuel supply passage 70 (step 102 in FIG. 9B).

On the other hand, since the engine 2 is not in operation (determined NO in step 201 in FIG. 9C), the electrical command signal given from an output unit 50*c* of the controller 50 to the valves 17, 18, and 19 is off and thus the valves 17, 18, 19 are closed, while the electrical command signal given from the output unit 50*c* of the controller 50 to the relay 13 to energize the relay 13 is off and thus the relay 13 is de-energized (step 202 in FIG. 9C). However, the relay 13 is energized by the operator's manipulation to turn on the switch 12 (step 102 in FIG. 9B).

Since the second on-off valve 17 is closed and thus the exhaust-pipe fuel supply passage 20 is closed, the fuel discharged from the dual-purpose pump 60 is inhibited from being supplied to the exhaust pipe 4 through the exhaust-pipe fuel supply passage 20.

Since the second on-off valve 17 is closed (determined YES in step 103 in FIG. 9B), the supply passage 20*b* coupled to the outlet 17*a* of the second on-off valve 17 is under the atmospheric pressure. This is because, as described later, the pressure in the supply passage 20*b* is reduced to the atmospheric pressure after the fuel has been supplied to the exhaust pipe 4 via the supply passage 20*b*. The supply passage 20*b* coupled to the outlet 17*a* of the second on-off valve 17 is communicated with the outlet 71*a* of the first on-off valve 71 via the fuel pressure signal passage 72, and therefore the outlet 71*a* of the first on-off valve 71 is subjected to the atmospheric pressure. In order to cause the first on-off valve 71 to assume the open state, the fuel pressure acting on the inlet 71*b* of the first on-off valve 71 must be made equal to or higher than the pressure of 2 kgf/cm$^2$ obtained by adding the cracking pressure (2 kgf/cm$^2$) to the fuel pressure (the atmospheric pressure) on the side of the outlet 71*a*. Since the fuel pressure of 7 kgf/cm$^2$ corresponding to the discharge pressure of the dual-purpose pump 60 is currently acting on the inlet 71*b* of first on-off valve 71, the first on-off valve 71 is opened. As a result, the fuel the pressure of which has been raised by the dual-purpose pump 60 is fed under pressure to the main filter 7 via the air-removal fuel supply passage 70, passing through the supply pump 8, and is discharged to the fuel tank 5 via the overflow fuel discharge passage 11. The fuel the pressure of which has been raised by the dual-purpose pump 60 is fed under pressure to the main filter 7 via the air-removal fuel supply passage 70, and is discharged to the fuel tank 5 via the air-removal fuel discharge passage 32. As a result, air is removed from the cylinder fuel supply passage 10 (step 104 in FIG. 9B).

As described above, the air removal from the cylinder fuel supply passage 10 is performed while the engine 2 is not in operation. Moreover, according to this embodiment, the air removal can be accomplished in a short period time since the air removal is performed under a high fuel pressure (7 kgf/cm$^2$) that is suitable for HC dosing and higher than the fuel pressure (about 3 to 5 kgf/cm$^2$) required for air removal.

Operation During Engine Operation when Neither Air Removal Nor HC Dosing is Performed (FIG. 2):

When the operator turns on an engine starting key switch (not shown), the engine 2 is started to operate (determined YES in step 201 in FIG. 9C). This activates the feed pump 1 and the supply pump 8 coupled to the crank shaft (not shown) of the engine 2 as shown in FIG. 2.

Upon operation of the feed pump 1, the fuel in the fuel tank 5 is sucked into the suction port 1*b* of the feed pump 1 via the supply passage 10*a*, the pre-filter 6, and the supply passage 10*b*. The feed pump 1 raises the pressure of the fuel to a fuel pressure of 3 kgf/cm$^2$, and discharges the fuel from the discharge port 1*a* to the supply passage 10*c*. The fuel the pressure of which has been raised by the feed pump 1 is sucked into the supply pump 8 via the supply passage 10*c*, the main filter 7, and the supply passage 10*d*.

The controller 50 receives a detection signal from the sensor 51 via an input unit 50*a*, and an arithmetic processing unit 50*b* determines based on the detection signal from the sensor 51 whether or not the recovery time has come. If it is determined that the recovery time has not come yet (determined NO in step 203 in FIG. 9C), no signal is generated to command fuel supply into the exhaust pipe 4 through the output unit 50*c* of the controller 50. Therefore, the electrical command signal to be given from the output unit 50*c* of the controller 50 to the valves 17, 18, and 19 is off, and hence the valves 17, 18, 19 are closed. At the same time, the electrical command signal to be given from the output unit 50*c* of the controller 50 to the relay 13 to energize the relay 13 is off, and hence the relay 13 is de-energized (step 204 in FIG. 9C).

Since the second on-off valve 17 is closed, the supply passage 20*b* coupled to the outlet 17*a* of the second on-off valve 17 is subjected to the atmospheric pressure. This is because, as described later, an operation is performed to lower the pressure in the supply passage 20*b* to the atmospheric pressure after the fuel has been supplied to the exhaust pipe 4 via the supply passage 20*b*. Since the supply passage 20*b* coupled to the outlet 17*a* of the second on-off valve 17 is communicated with the outlet 71*a* of the first on-off valve 71 via the fuel pressure signal passage 72, the outlet 71*a* of the first on-off valve 71 is subjected to the atmospheric pressure.

The switch 12 is off when air removal from the cylinder fuel supply passage 10 is not performed (determined NO in step 101 in FIG. 9B). When the switch 12 is off, no signal is generated to command air removal from the cylinder fuel supply passage 10, and the electrical command signal for energizing the relay 13 is off.

As described above, the electrical command signal for energizing the relay 13 is not applied to the relay 13, and hence the relay 13 is de-energized. Accordingly, the dual-purpose pump 60 is not activated.

As a result, the discharge pressure of the dual-purpose pump 60 does not act on the inlet 71*b* of the first on-off valve 71 from the discharge port 60*a* of the dual-purpose pump 60 through the air-removal fuel supply passage 70, and thus the pressure on the inlet 71*b* side of the first on-off valve 71 is the atmospheric pressure.

Thus, the pressure acting on the inlet 71*b* of the first on-off valve 71 is the atmospheric pressure, whereas the pressure acting on the outlet 71*a* thereof is 2 kgf/cm$^2$ obtained by adding the cracking pressure (2 kgf/cm$^2$) to the atmospheric pressure. Accordingly, the first on-off valve 71 is closed. As a result, the engine 2 is operated while no fuel is discharged from the dual-purpose pump 60 to either the air-removal fuel supply passage 70 or the exhaust-pipe fuel supply passage 20.

Operation During HC Dosing (FIG. 3):

Upon the operator turning on the engine starting key switch (not shown), the engine 2 is started to operate (determined YES in step 201 in FIG. 9C). As shown in FIG. 3, this activates the feed pump 1 and the supply pump 8 coupled to the crank shaft (not shown) of the engine 2.

Upon operation of the feed pump 1, the fuel in the fuel tank 5 is sucked into the suction port 1*b* of the feed pump 1 via the supply passage 10*a*, the pre-filter 6, and the supply passage 10*b*. The feed pump 1 raises the pressure of the fuel to a fuel pressure of 3 kgf/cm$^2$ and discharges the fuel from the discharge port 1*a* to the supply passage 10*c*. The fuel the pressure of which has been raised by the feed pump 1 is sucked into the supply pump 8 via the supply passage 10*c*, the main filter 7, and the supply passage 10*d*.

If the controller 50 determines, based on the detection signal from the sensor 51, that the recovery time has come (determined YES in step 203 in FIG. 9C), a signal to command fuel supply into the exhaust pipe 4 is generated from the output unit 50*c* of the controller 50. As a result, an electrical command signal is output from the output unit 50*c* of the controller 50 to the valves 17 and 19, whereby the valves 17 and 19 are opened and the valve 18 is closed. At the same time, an electrical command signal for energizing the relay 13 is output from the output unit 50*c* of the controller 50 to the relay 13, whereby the relay 13 is energized (step 205 in FIG. 9C). The dual-purpose pump 60 is activated by the energization of the relay 13. In this manner, the dual-purpose pump 60 is activated while the engine 2 is in operation. Upon operation of the dual-purpose pump 60, the fuel in the fuel tank 5 is sucked into the suction port 60*b* of the dual-purpose pump 60 via the supply passage 10*a*, the pre-filter 6, the supply passage 10*b*, and the fuel suction passage 30.

The dual-purpose pump 60 discharges the fuel from the discharge port 60*a* into the supply passage 20*a* after raising the pressure of the fuel to a fuel pressure of 7 kgf/cm$^2$ suitable for supply into the exhaust pipe 4. The fuel the pressure of which has been raised by the dual-purpose pump 60 is injected and supplied into the exhaust pipe 4 via the supply passage 20*a*, the second on-off valve 17, the flow control valve 19, the supply passage 20*b*, and the nozzle 21. The opening area of the flow control valve 19 is adjusted so as to provide a flow rate required for HC dosing, so that the fuel is supplied to the nozzle 21 at a required flow rate. As a result, the recovery is performed (step 206 in FIG. 9C). The third on-off valve 18 is changed from the close state to the open state at the termination of the HC dosing, thereby lowering the pressure in the fuel supply passage 20*b* between the third on-off valve 18 and the flow control valve 19 to the atmospheric pressure.

The discharge pressure of 7 kgf/cm$^2$ of the dual-purpose pump 60 also acts on the inlet 71*b* of the first on-off valve 71 in the air-removal fuel supply passage 70.

On the other hand, since the recovery time has come (determined YES in step 203 in FIG. 9C) and the second on-off valve 17 is opened, the pressure in the supply passage 20*b* coupled to the outlet 17*a* of the second on-off valve 17 also becomes the discharge pressure of 7 kgf/cm$^2$ of the dual-purpose pump 60. Since the supply passage 20*b* coupled to the outlet 17*a* of the second on-off valve 17 is communicated with the outlet 71*a* of the first on-off valve 71 via the fuel pressure signal passage 72, the outlet 71*a* of the first on-off valve 71 is subjected to the discharge pressure 7 kgf/cm$^2$ of the dual-purpose pump 60.

As described above, the pressure acting on the inlet 71*b* of the first on-off valve 71 is the discharge pressure 7 kgf/cm$^2$ of the dual-purpose pump 60, while the pressure acting on the outlet 71*a* side is 9 kgf/cm$^2$ obtained by adding the cracking pressure (2 kgf/cm$^2$) to the discharge pressure of 7 kgf/cm$^2$ of the dual-purpose pump 60. Accordingly, the first on-off valve 71 is closed. Thus, the first on-off valve 71 is closed, whereby the air-removal fuel supply passage 70 is closed. Accordingly, the fuel discharged from the dual-purpose pump 60 is inhibited from being supplied to the main filter 7 in the cylinder fuel supply passage 10 through the air-removal fuel supply passage 70.

As described above, HC dosing is performed so that the recovery operation is performed while the engine 2 is in operation.

According to this embodiment as described above, both air removal from the cylinder fuel supply passage 10 and fuel supply to the exhaust pipe 4 can be performed with the use of the dual-purpose pump 60, thereby reducing the system cost.

Figure 2:
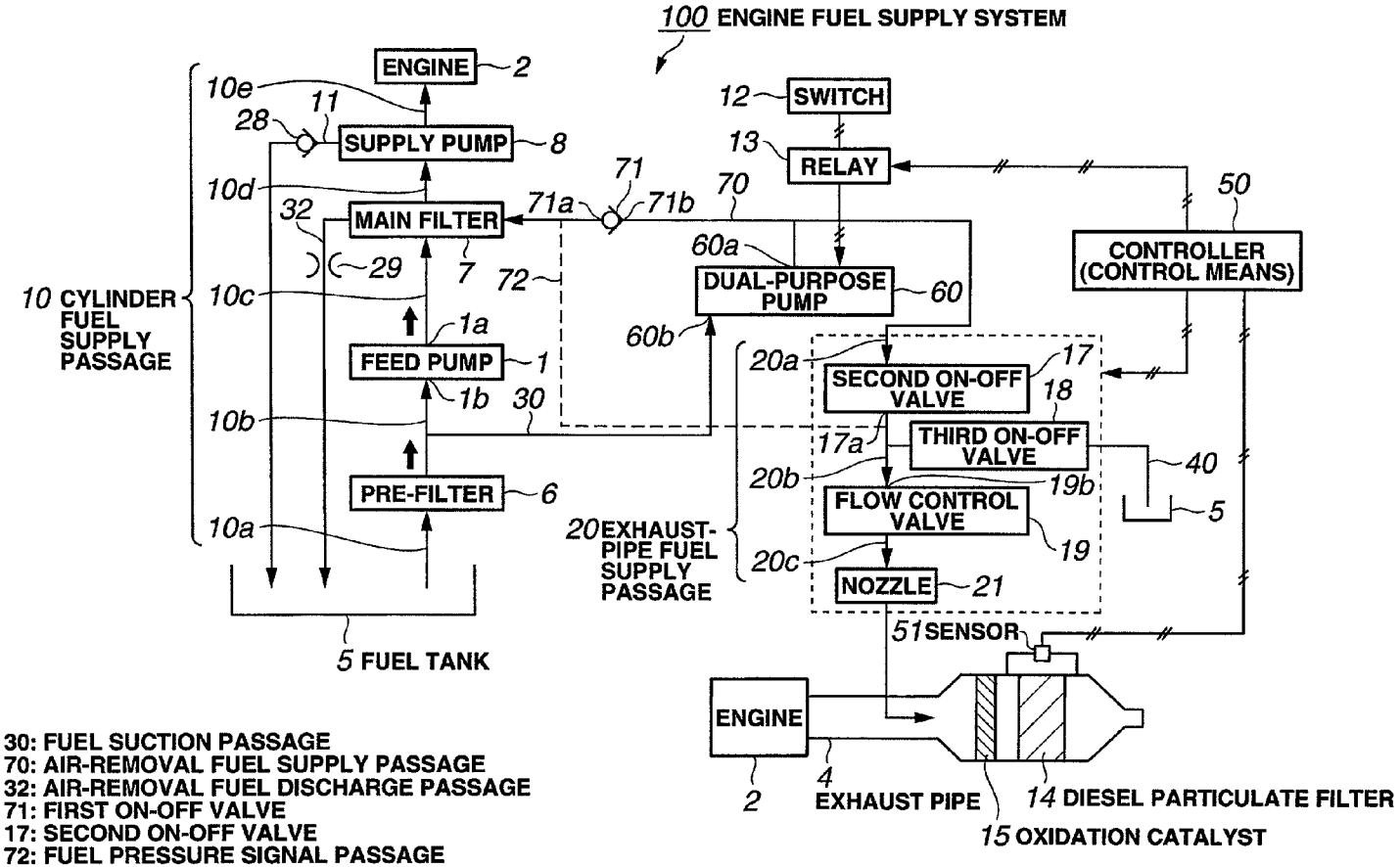
FIG. 2 is a diagram for explaining operation performed by the system of FIG. 1 when neither air removal nor HC dosing is performed during operation of the engine.
Figure 3:
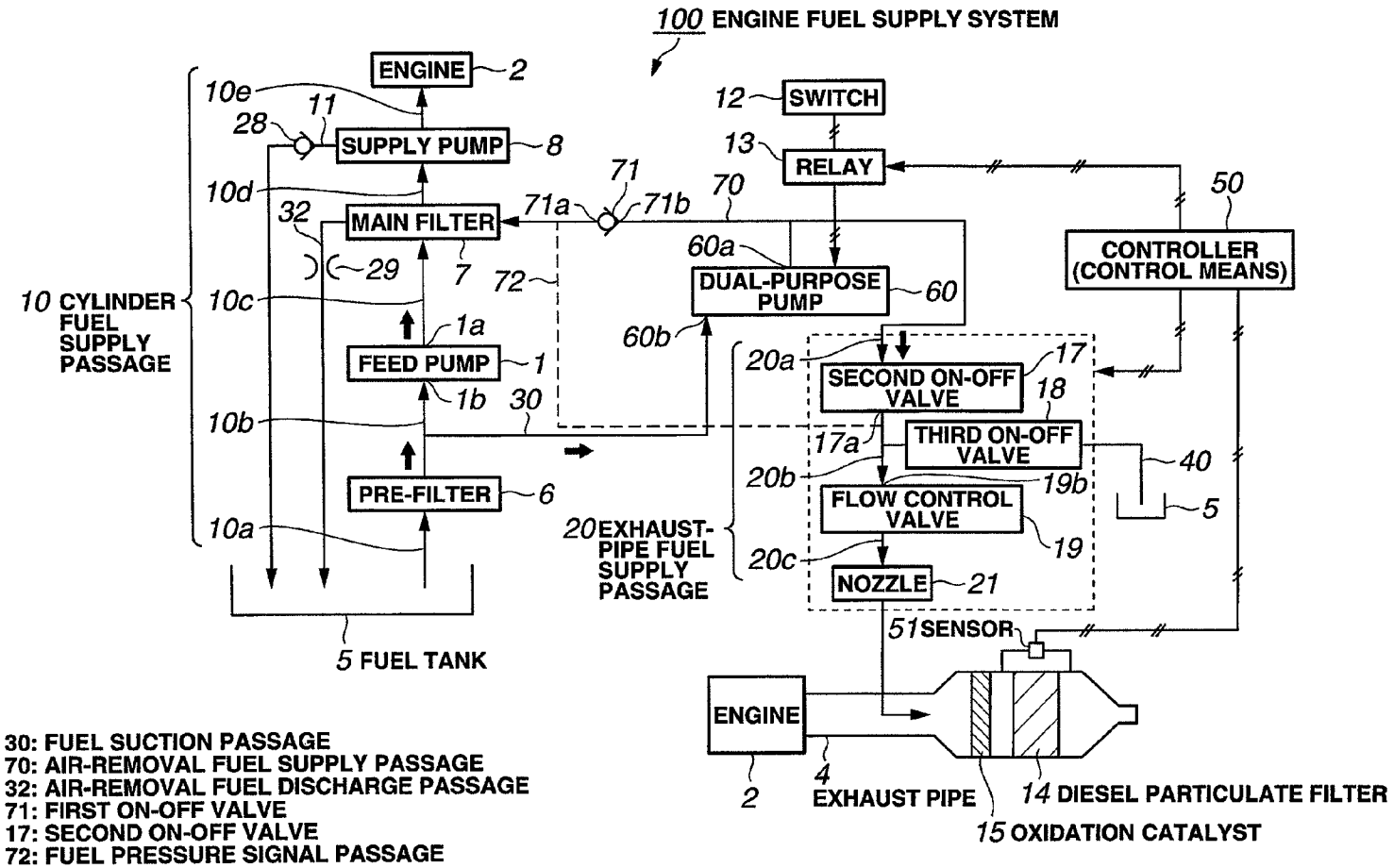
FIG. 3 is a diagram for explaining operation performed by the system of FIG. 1 when HC dosing is performed during operation of the engine.

Although the embodiment shown in FIGS. 1, 2, and 3 has been described on the assumption that the first on-off valve 71 is opened/closed by a fuel pressure signal, the first on-off valve 71 may be opened/closed by an electrical signal.

Figure 4:
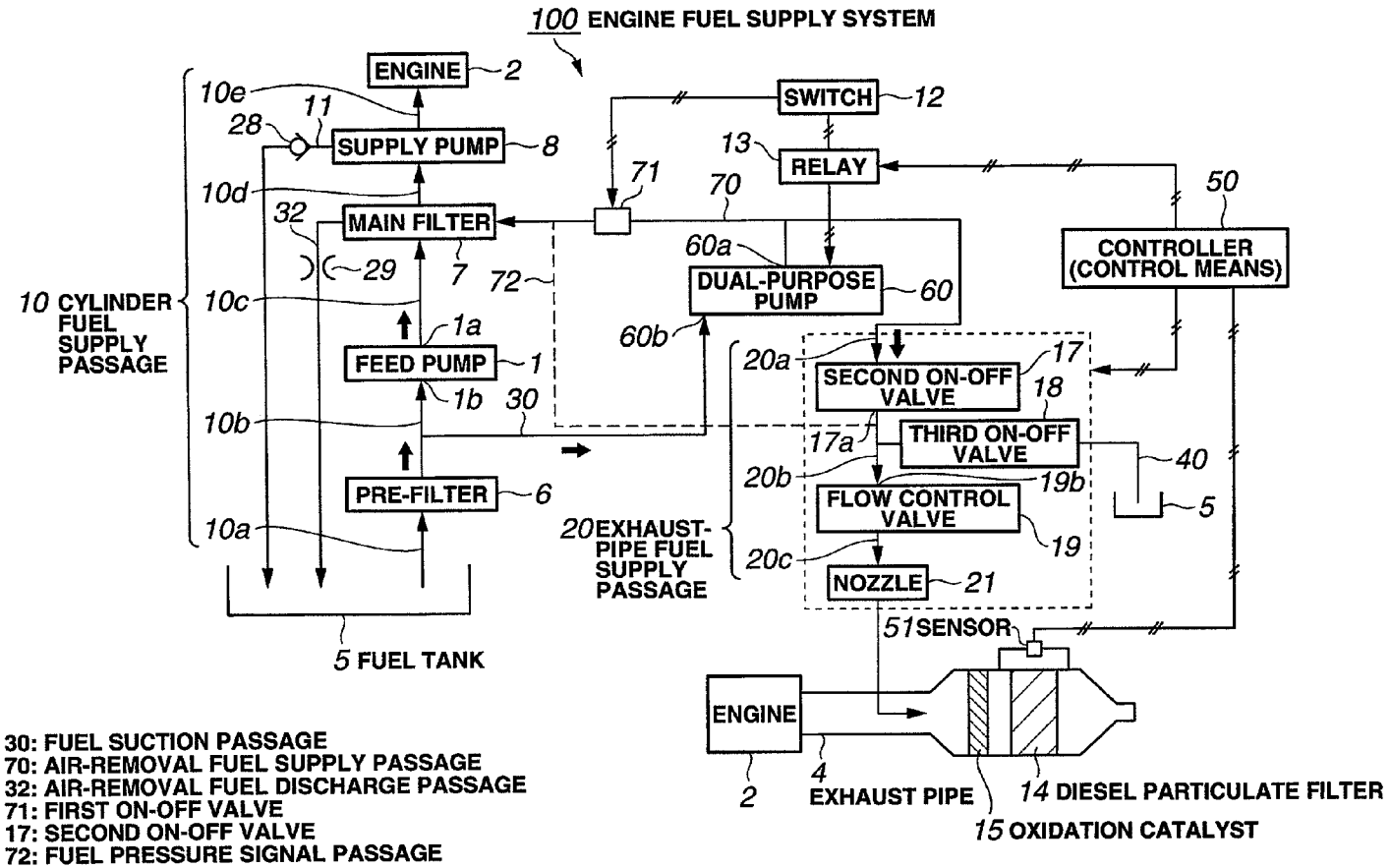
FIG. 4 is a diagram showing a configuration in which the first on-off valve shown in FIG. 1 is formed by a valve which is operated by application of an electrical command signal.

FIG. 4 is a diagram corresponding to FIGS. 1 to 3, and showing an embodiment in which the first on-off valve 71 is formed by an electromagnetic valve which is opened and closed by application of an electrical command signal. The black arrows in FIG. 4 indicate the flowing directions of fuel during HC dosing.

Operation During Air Removal in FIG. 4:

In order to perform "air removal", the switch 12 is turned on so that a signal to command air removal from the cylinder fuel supply passage 10 is generated at the switch 12. The command signal is applied as an electrical command signal from the switch 12 to the first on-off valve 71, whereby the first on-off valve 71 is opened. Since the controller 50 generates no signal to command fuel supply into the exhaust pipe 4, the second on-off valve 17 is closed. As a result, in the same manner as in FIG. 1, air removal from the cylinder fuel supply passage 10 is performed while HC dosing is not performed.

Operation when Neither Air Removal Nor HC Dosing is Performed in FIG. 4:

"During engine operation while neither air removal nor HC dosing is performed", the switch 12 is off, and no signal is generated to command air removal from the cylinder fuel supply passage 10. Since this signal is not applied as an electrical command signal to the first on-off valve 71, the first on-off valve 71 is closed. Further, since the controller 50 generates no signal to command fuel supply into the exhaust pipe 4, the second on-off valve 17 is closed. Accordingly, in the same manner as in FIG. 2, neither air removal nor HC dosing is performed.

Operation During HC Dosing in FIG. 4:

"During HC dosing", the switch 12 is off, and no signal is generated to command air removal from the cylinder fuel supply passage 10. Since no such command signal is applied as an electrical command signal to the first on-off valve 71, the first on-off valve 71 is closed. Further, the controller 50 generates a signal to command fuel supply into the exhaust pipe 4, and this signal is applied as an electrical command signal to the second on-off valve 17, whereby the second on-off valve 17 is opened. As a result, in the same manner as in FIG. 3, HC dosing is performed and the fuel is supplied into the exhaust pipe 4.

Although the system shown in FIG. 1 is designed such that the fuel is always sucked into the dual-purpose pump 60 from the supply passage 10*b* on the suction port 1*b* side of the feed pump 1, the system may be designed such that the fuel is sucked into the dual-purpose pump 60 from the supply passage 10*c* on the discharge port 1*a* side of the feed pump 1 when HC dosing is performed during operation of the engine 2, so that the dual-purpose pump 60 can be formed by a small-sized pump having a low pressure-raising capacity.

Figure 5:
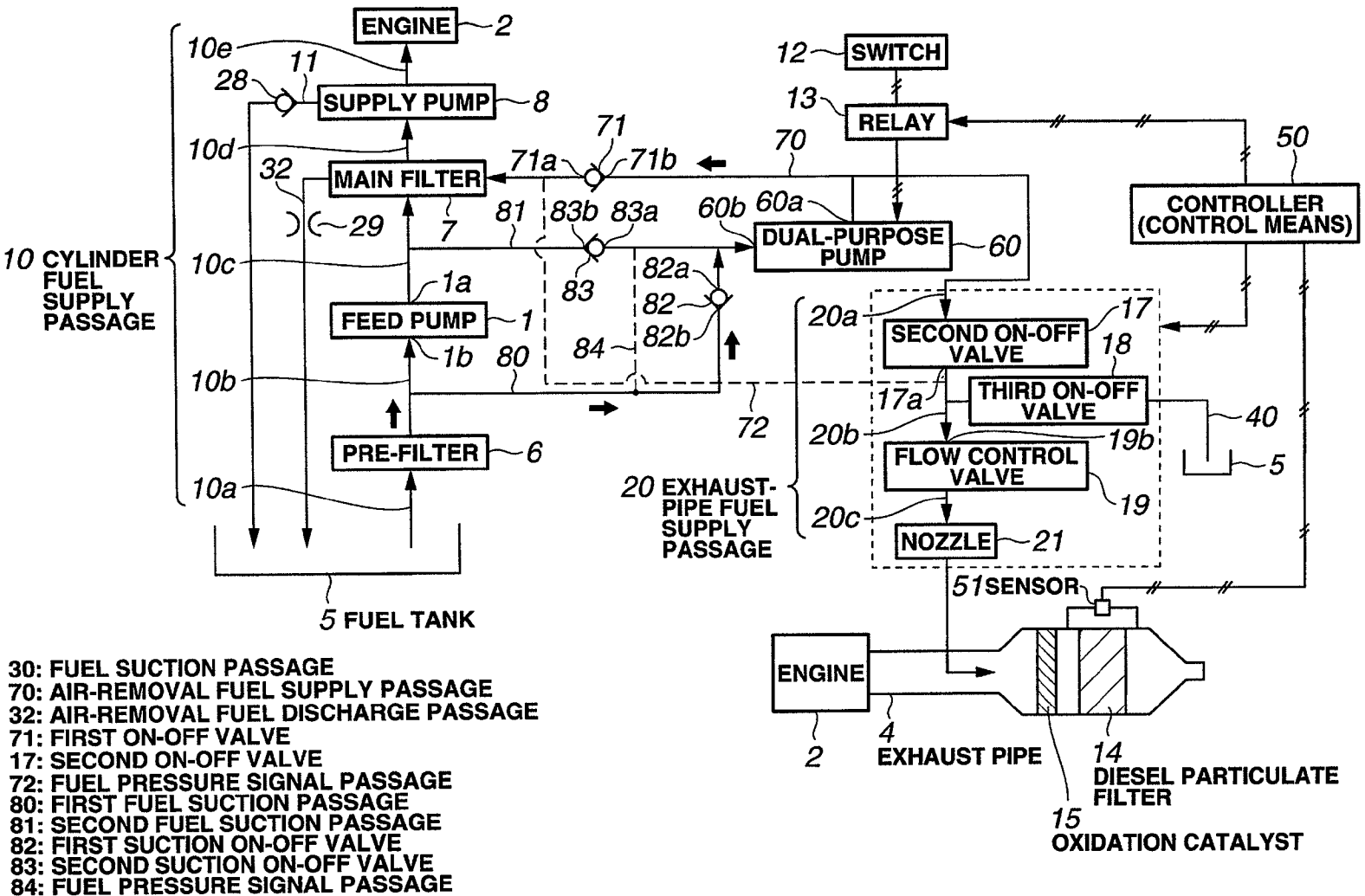
FIG. 5 is a configuration diagram showing an engine fuel supply system according to a different embodiment from that shown in FIG. 1 and is a diagram for explaining operation to perform air removal while the engine is not in operation.

FIG. 5 illustrates an embodiment in which when air removal is performed while the engine 2 is not in operation, the dual-purpose pump 60 sucks the fuel from the supply passage 10 on the suction port 1*b* side of the feed pump 1, whereas when HC dosing is performed while the engine 2 is in operation, the dual-purpose pump 60 sucks the fuel from the supply passage 10*c* on the discharge port 1*a* side of the feed pump 1.

In the following description, components corresponding to those in FIG. 1 are assigned with the same reference numerals and description will be omitted where appropriate.

In the system according to the embodiment shown in FIG. 5, the supply passage 10*b* on the suction port 1*b* side of the feed pump 1 in the cylinder fuel supply passage 10 is communicated with the suction port 60*b* of the dual-purpose pump 60 by a first fuel suction passage 80.

The supply passage 10*c* on the discharge port 1*a* side of the feed pump 1 in the cylinder fuel supply passage 10 is communicated with the suction port 60*b* of the dual-purpose pump 60 by a second fuel suction passage 81.

A first suction on-off valve 82 is provided on the first fuel suction passage 80 to open and close the first fuel suction passage 80. The first suction on-off valve 82 is formed by a check valve which allows only flow of the fuel flowing from the supply passage 10*b* on the suction port 1*b* side of the feed pump 1 to the suction port 60*b* of the dual-purpose pump 60.

A second suction on-off valve 83 is provided on the second fuel suction passage 81 to open and close the second fuel suction passage 81. The second suction on-off valve 83 is formed by a check valve which allows only flow of the fuel flowing from the supply passage 10*c* on the discharge port 1*a* side of the feed pump 1 to the suction port 60*b* of the dual-purpose pump 60.

The supply passage 10*b* on the suction port 1*b* side of the feed pump 1 is communicated with the outlet 83*a* of the second suction on-off valve 83 by a fuel pressure signal passage 84.

Operation During Air Removal (FIG. 5):

The operator turns the switch 12 on in order to perform air removal before starting the engine 2, that is, the engine 2 is not in operation.

Upon the switch 12 being turned on, a signal is generated to command air removal from the cylinder fuel supply passage 10 and the relay 13 is energized. The dual-purpose pump 60 is activated by energization of the relay 13.

Since the engine 2 is not in operation, the feed pump 1 is not activated and no fuel is discharged from the discharge port 1*a* of the feed pump 1. The pressure in the supply passage 10*c* on the discharge port 1*a* side is the atmospheric pressure, and the pressure at the inlet 83*b* of the second suction on-off valve 83 is also the atmospheric pressure. On the other hand, the pressure in the supply passage 10*b* on the suction port 1*b* side of the feed pump 1 is the atmospheric pressure, and the pressure at the inlet 82*b* of the first suction on-off valve 82 is also the atmospheric pressure. The outlet 82*a* of the first suction on-off valve 82 and the outlet 83*a* of the second suction on-off valve 83 are also subjected to the atmospheric pressure via the fuel pressure signal passage 84. Accordingly, the second suction on-off valve 83 is closed, and the first suction on-off valve 82 is opened. Upon operation of the dual-purpose pump 60, the fuel in the fuel tank 5 is sucked into the suction port 60*b* of the dual-purpose pump 60 from the supply passage 10*b* on the suction port 1*b* side of the feed pump 1 via the first fuel suction passage 80. The dual-purpose pump 60 discharges the fuel to the air-removal fuel supply passage 70 after raising the pressure of the fuel from the atmospheric pressure up to 4 kgf/cm$^2$.

As described above, when a signal is generated to command air removal from the cylinder fuel supply passage 10, the first suction on-off valve 82 is opened and the second suction on-off valve 83 is closed, whereby the fuel is sucked into the suction port 60*b* of the dual-purpose pump 60 from the suction port 1*b* side of the feed pump 1 via the first fuel suction passage 80. The other steps of the operation are the same as in FIG. 1 and air removal is performed.

Figure 6:
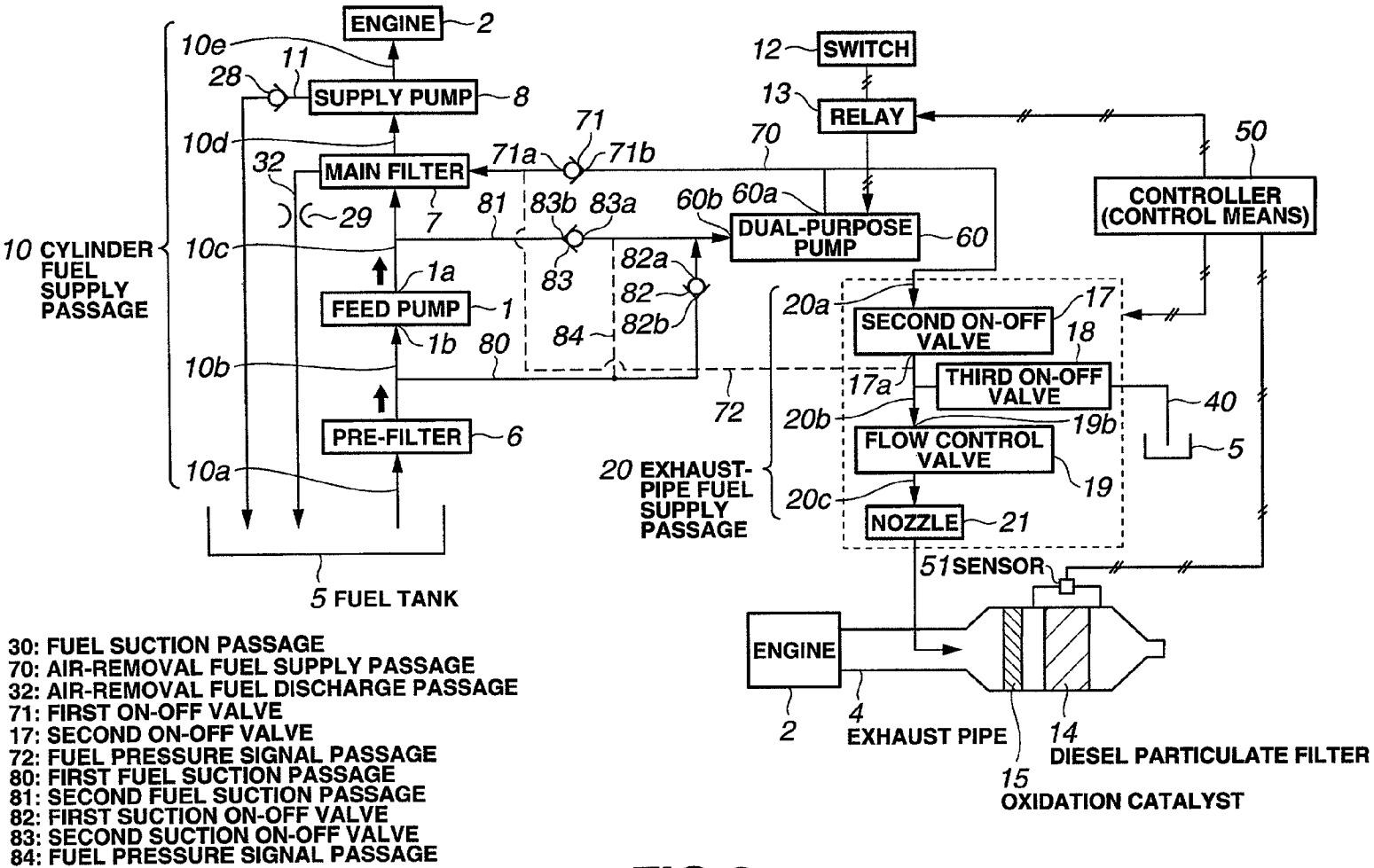
FIG. 6 is a diagram for explaining operation performed by the system of FIG. 5 when neither air removal nor HC dosing is performed during operation of the engine.

Operation During Engine Operation when Neither Air Removal Nor HC Dosing is Performed (FIG. 6):

Upon the operator turning on an engine starting key switch (not shown), the engine 2 is started to operate. As shown in FIG. 6, this activates the feed pump 1 and the supply pump 8 coupled to a crank shaft (not shown) of the engine 2.

Upon operation of the feed pump 1, the fuel in the fuel tank 5 is sucked into the suction port 1*b* of the feed pump 1 via the supply passage 10*a*, the pre-filter 6, and the supply passage 10*b*. The feed pump 1 discharges the fuel into the supply passage 10*c* from the discharge port 1*a* after raising the pressure of the fuel up to 3 kgf/cm$^2$. The fuel the pressure of which has been raised by the feed pump 1 is sucked into the supply pump 8 via the supply passage 10*c*, the main filter 7, and the supply passage 10*d*.

If the controller 50 determines based on a detection signal from the sensor 51 that the recovery time has not come yet, the controller 50 does not generate a signal to command fuel supply into the exhaust pipe 4. Therefore, an electrical command signal given by the controller 50 to the valves 17, 18, and 19 is off and hence the valves 17, 18, and 19 are closed, while an electrical command signal given by the controller 50 to the relay 13 to energize the same is also off.

The switch 12 is off when air removal from the cylinder fuel supply passage 10 is not performed. When the switch 12 is off, no signal is generated to command air removal from the cylinder fuel supply passage 10, and the electrical command signal to energize the relay 13 is off.

As described above, the electrical command signal to energize the relay 13 is not applied to the relay 13, and hence the relay 13 is de-energized. As a result, the dual-purpose pump 60 is not activated.

Upon operation of the feed pump 1, the fuel is discharged from the discharge port 1*a* of the feed pump 1, the fuel pressure in the supply passage 10*c* on the discharge port 1*a* side becomes 3 kgf/cm$^2$, and this fuel pressure is applied to the inlet 83*b* side of the second suction on-off valve 83. On the other hand, the pressure in the supply passage 10*b* on the suction port 1*b* side of the feed pump 1 is the atmospheric pressure, and hence the pressure at the inlet 82*b* of the first suction on-off valve 82 also becomes the atmospheric pressure. At the same time, the pressure at the outlet 82*a* of the first suction on-off valve 82 and at the outlet 83*a* of the second suction on-off valve 83 also becomes the atmospheric pressure via the fuel pressure signal passage 84. As a result, the first suction on-off valve 82 is closed and the second suction on-off valve 83 is opened. However, since the dual-purpose pump 60 is not in operation, the fuel dose not flow toward the suction port 60*b* of the dual-purpose pump 60 through the second suction on-off valve 83.

Figure 7:
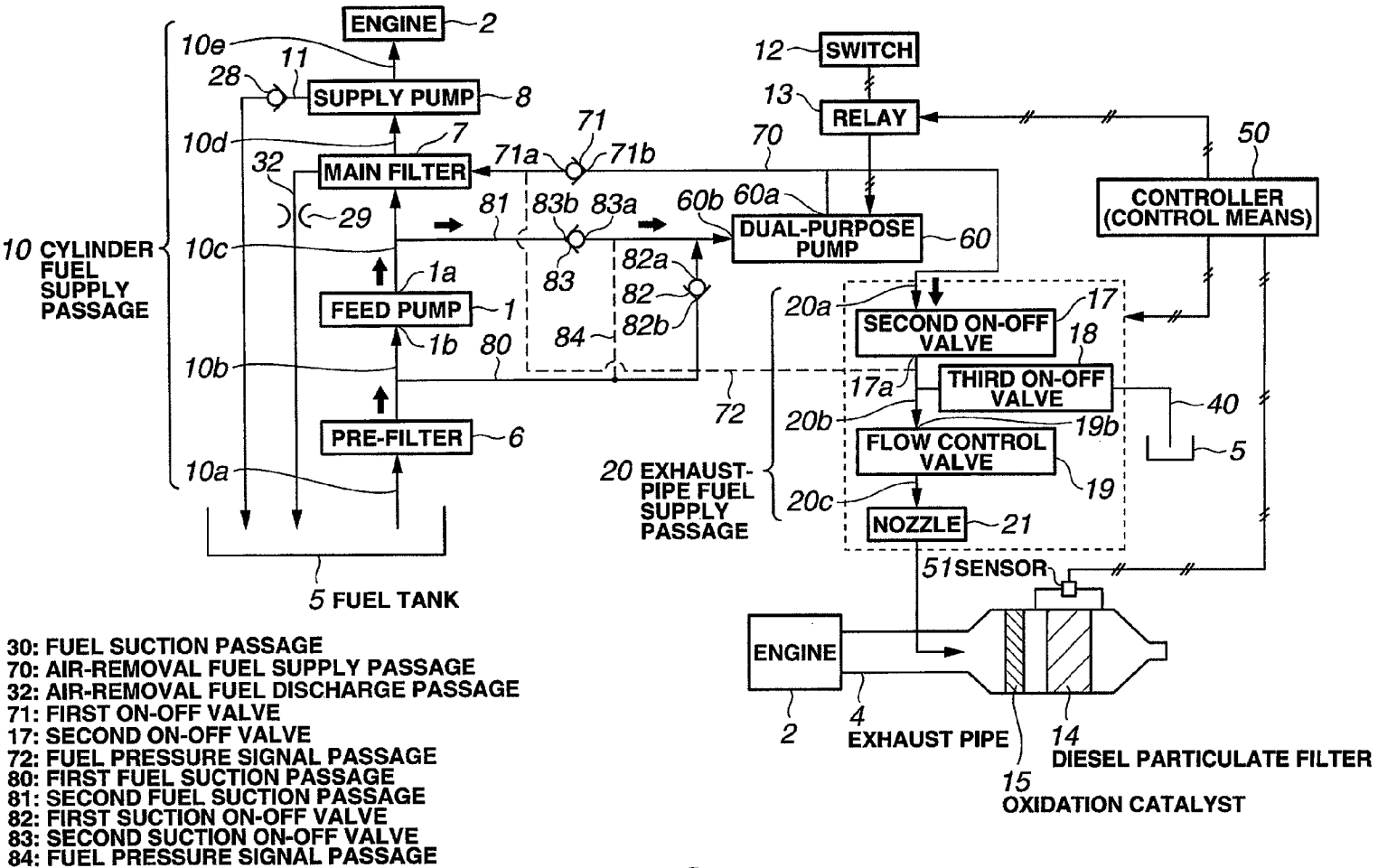
FIG. 7 is a diagram for explaining operation performed by the system of FIG. 5 when HC dosing is performed during operation of the engine.

Operation During HC Dosing (FIG. 7):

Upon the operator turning on an engine starting key switch (not shown), the engine 2 is started to operate. As shown in FIG. 7, this activates the feed pump 1 and the supply pump 8 coupled to a crank shaft (not shown) of the engine 2.

If the controller 50 determines based on a detection signal from the sensor 51 that the recovery time has come, the controller 50 generates a signal to command fuel supply into the exhaust pipe 4. Thus, an electrical command signal is output from the controller 50 to the valves 17 and 19 whereby the valves 17 and 19 are opened while the valve 18 is closed. At the same time, an electrical command signal to energize the relay 13 is output from the controller 50 to the relay 13, whereby the relay 13 is energized. The dual-purpose pump 60 is activated by the energization of the relay 13. In this manner, the dual-purpose pump 60 is activated while the engine 2 is in operation.

Upon operation of the feed pump 1, the fuel is discharged from the discharge port 1*a* of the feed pump 1, the fuel pressure in the supply passage 10*c* on the discharge port 1*a* side becomes 3 kgf/cm$^2$, and this fuel pressure is applied to the inlet 83*b* side of the second suction on-off valve 83. On the other hand, the pressure in the supply passage 10*b* on the suction port 1*b* side of the feed pump 1 is the atmospheric pressure, and the pressure at the inlet 82*b* of the first suction on-off valve 82 also becomes the atmospheric pressure. At the same time, the pressure at the outlet 82*a* of the first suction on-off valve 82 and at the outlet 83*a* of the second suction on-off valve 83 also becomes the atmospheric pressure via the fuel pressure signal passage 84. Therefore, the first suction on-off valve 82 is closed while the second suction on-off valve 83 is opened, and the fuel the pressure of which has been raised to 3 kgf/cm$^2$ is sucked from the supply passage 10*c* on the discharge port 1*a* side of the feed pump 1 into the suction port 60*b* of the dual-purpose pump 60 through the second fuel suction passage 81. The dual-purpose pump 60 further raises the fuel pressure, which has already been raised to 3 kgf/cm$^2$, up to 7 kgf/cm$^2$, and discharges the fuel to the exhaust-pipe fuel supply passage 20.

In this manner, when a signal is generated to command fuel supply into the exhaust pipe 4, the second suction on-off valve 83 assumes the open state and the first suction on-off valve 82 assumes the close state, whereby the fuel is sucked from the discharge port 1*a* side of the feed pump 1 into the suction port 60*b* of the dual-purpose pump 60 via the second fuel suction passage 81. The other steps of the operation are the same as in FIG. 3 and HC dosing is performed.

As described above, according to the embodiment shown in FIGS. 5, 6, and 7, when the fuel is to be supplied into the exhaust pipe 4, the fuel is sucked from the discharge port 1*a* side of the feed pump 1 into the dual-purpose pump 60, in which the pressure of the fuel is raised to a fuel pressure of 7 kgf/cm$^2$ that is suitable for supplying the fuel into the exhaust pipe 4.

During fuel supply to the exhaust pipe 4, the engine 2 is in operation and the feed pump 1 is activated. The dual-purpose pump 60 is only required to further raise the fuel pressure, which has already been raised to a predetermined pressure of about 3 kgf/cm$^2$ by the feed pump 1, up to a pressure of about 7 kgf/cm$^2$ that is suitable for supplying the fuel into exhaust pipe 4. Therefore, the pressure raising capacity required of the dual-purpose pump 60 can be lower than the case of raising the fuel pressure which has not been raised previously.

On the other hand, air removal from the cylinder fuel supply passage 10 is performed principally when the engine 2 is not in operation. According to this embodiment, when performing air removal from the cylinder fuel supply passage 10, the fuel in the fuel tank 5 is sucked from the suction port 1*b* side of the feed pump 1 into the dual-purpose pump 60. Therefore, even when the engine 2 is not in operation and the feed pump 1 is not activated, the fuel can be sucked effectively from the fuel tank 5 on the suction port 1*b* side of the feed pump 1. The pressure of 4 kgf/cm$^2$ that is obtained by raising the pressure of the fuel in the fuel tank 5 (the atmospheric pressure) by the dual-purpose pump 60 is lower than the fuel pressure of 7 kgf/cm$^2$ that is obtained by further raising the pressure of the fuel that has been previously raised to a predetermined pressure of the 3 kgf/cm$^2$ by operation of the feed pump 1. However, since the air removal from the cylinder fuel supply passage 10 can be performed under a lower fuel pressure than the pressure used for supplying fuel into the exhaust pipe 4, the air removal from the cylinder fuel supply passage 10 can be performed satisfactorily under this fuel pressure.

According to this embodiment, the pressure raising capacity required of the dual-purpose pump 60 can be reduced, and hence the size of the dual-purpose pump 60 can be reduced.

Although the description of the embodiment shown in FIGS. 5, 6, and 7 has been made on the assumption that the first on-off valve 71, the first suction on-off valve 82, and the second suction on-off valve 83 are opened/closed by means of a fuel pressure signal, the first on-off valve 71, the first suction on-off valve 82, and the second suction on-off valve 83 may be opened/closed by means of an electrical signal.

Figure 8:
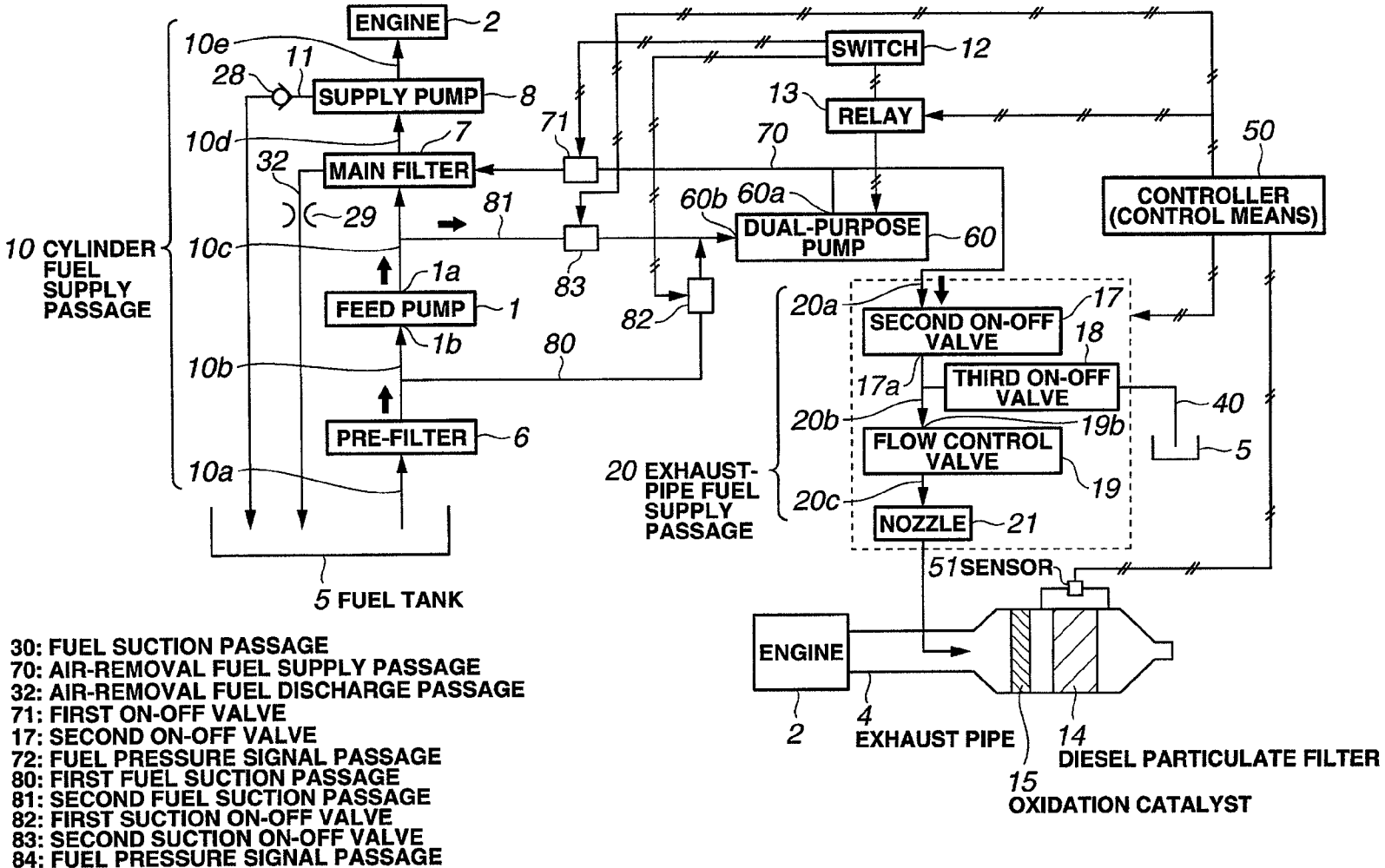
FIG. 8 is a diagram showing a configuration in which the first on-off valve, the first suction on-off valve, and the second suction on-off valve shown in FIG. 5 are each formed by a valve which is operated by application of an electrical command signal.

FIG. 8 is a diagram corresponding to FIGS. 1 to 3 and shows an embodiment in which each of the first on-off valve 71, the first suction on-off valve 82, and the second suction on-off valve 83 is formed by an electromagnetic valve that is opened and closed by an electrical command signal applied thereto.

In FIG. 8, the black arrows indicate the flowing directions of the fuel during HC dosing.

Operation During Air Removal in FIG. 8:

When "air removal" is to be performed, the switch 12 is turned on and a signal is generated by the switch 12 to command air removal from the cylinder fuel supply passage 10. This command signal is given from the switch 12 to the first suction on-off valve 82 as an electrical command signal, so that the first suction on-off valve 82 assumes the open state. Since the controller 50 generates no signal to command fuel supply to the exhaust pipe 4, the electrical command signal given to the second suction on-off valve 83 is off, and thus the second suction on-off valve 83 assumes the close state. As a result, the fuel is sucked from the suction port 1*b* side of the feed pump 1 into the suction port 60*b* of the dual-purpose pump 60 via the first fuel suction passage 80.

On the other hand, when the switch 12 is turned on and a signal is generated by the switch 12 to command air removal from the cylinder fuel supply passage 10, this command signal is given by the switch 12 to the first on-off valve 71 as an electrical command signal, whereby the first on-off valve 71 is opened. Since the controller 50 generates no signal to command fuel supply to the exhaust pipe 4, the second on-off valve 17 is closed. Thus, in the same manner as in FIG. 5, HC dosing is not performed, whereas air removal from the cylinder fuel supply passage 10 is performed.

Operation when Neither Air Removal Nor HC Dosing is Performed in FIG. 8:

"During engine operation when neither air removal nor HC dosing is performed", the switch 12 is off and hence no signal is generated to command air removal from the cylinder fuel supply passage 10. Since the controller 50 generates no signal to command fuel supply to the exhaust pipe 4, the first suction on-off valve 82 is closed by the controller 50 and the second suction on-off valve 83 is also closed.

On the other hand, the first on-off valve 71 is closed since no signal is generated to command air removal from the cylinder fuel supply passage 10 and this command signal is not given to the first on-off valve 71 as an electrical command signal. Further, the second on-off valve 17 is also closed since the controller 50 generates no signal to command fuel supply to the exhaust pipe 4. As a result, in the same manner as in FIG. 6, neither air removal nor HC dosing is performed.

Operation During HC Dosing in FIG. 8:

"During HC dosing", the switch 12 is off and hence no signal is generated to command air removal from the cylinder fuel supply passage 10. Since the electrical command signal to be given to the first suction on-off valve 82 is off, the first suction on-off valve 82 assumes the close state. The controller 50 generates a signal to command fuel supply into the exhaust pipe 4, and the electrical command signal is given to the second suction on-off valve 83 so that the second suction on-off valve 83 assumes the open state. As a result, the fuel under a high pressure is sucked from the discharge port 1*a* side of the feed pump 1 into the suction port 60*b* of the dual-purpose pump 60 via the second fuel suction passage 81.

On the other hand, since the switch 12 is off, no signal is generated to command air removal from the cylinder fuel supply passage 10. Since this signal is not applied to the first on-off valve 71 as an electrical command signal, the first on-off valve 71 is closed. The controller 50 generates a signal to command fuel supply into the exhaust pipe 4, and this signal is applied to the second on-off valve 17 as an electrical command signal, whereby the second on-off valve 17 is opened. Accordingly, in the same manner as in FIG. 7, I-IC dosing is performed and the fuel is supplied into the exhaust pipe 4.

Although the description above the exemplary embodiments has been made on the assumption of a case in which the fuel is supplied to the exhaust pipe 4 for the purpose of recovering the function of an exhaust gas aftertreatment device such as the diesel particulate filter 14, this invention is not limited to such purpose and is applicable to a case in which the fuel is supplied to an exhaust gas aftertreatment device provided within the exhaust pipe 4 for any desired purpose. For example, the invention may be applied to a case in which a catalyst is provided on the exhaust pipe 4 for removing NOx in the exhaust gas, and light oil fuel serving as a reducing agent with respect to the catalyst is injected and supplied under a high pressure into the exhaust pipe for the purpose of enhancing the NOx removal efficiency of the catalyst.

The invention claimed is:

1. An engine fuel supply system comprising a cylinder fuel supply passage for supplying fuel into an engine cylinder by a fuel pump, and an exhaust-pipe fuel supply passage for supplying fuel into an engine exhaust pipe, the engine fuel supply system being characterized by comprising:

a dual-purpose pump provided separately from the fuel pump to serve both for air removal from the cylinder fuel supply passage and for fuel supply into the exhaust pipe;

an air-removal fuel supply passage that communicates a discharge port of the dual-purpose pump with the cylinder fuel supply passage;

the exhaust-pipe fuel supply passage that communicates the discharge port of the dual-purpose pump with the exhaust pipe;

a first on-off valve provided on the air-removal fuel supply passage for opening/closing the air-removal fuel supply passage;

a second on-off valve provided on the exhaust-pipe fuel supply passage for opening/closing the exhaust-pipe fuel supply passage; and control means which, when a signal is generated to command air removal from the cylinder fuel supply passage, activates the dual-purpose pump, causes the first on-off valve to assume an open state, and causes the second on-off valve to assume a close state, so that the fuel is supplied from the dual-purpose pump to the cylinder fuel supply passage via the air-removal fuel supply passage, and which, when a signal is generated to command fuel supply into the exhaust pipe, activates the dual-purpose pump, causes the second on-off valve to assume the open state, and causes the first on-off valve to assume the close state, so that the fuel is supplied from the dual-purpose pump to the exhaust pipe via the exhaust-pipe fuel supply passage.

2. The engine fuel supply system as claimed in claim 1, characterized by further comprising:

a first fuel suction passage that communicates a fuel supply passage on a suction port side of the fuel pump in the cylinder fuel supply passage with a suction port of the dual-purpose pump;

a second fuel suction passage that communicates a fuel supply passage on a discharge port side of the fuel pump in the cylinder fuel supply passage with the suction port of the dual-purpose pump;

a first suction on-off valve provided on the first fuel suction passage for opening/closing the first fuel suction passage;

a second suction on-off valve provided on the second fuel suction passage for opening/closing the second fuel suction passage; and control means which, when the signal is generated to command air removal from the cylinder fuel supply passage, causes the first suction on-off valve to assume the open state, and causes the second suction on-off valve to assume the close state, so that the fuel is sucked into the suction port of the dual-purpose pump from the suction port side of the fuel pump via the first fuel suction passage, and which, when the signal is generated to command fuel supply into the exhaust pipe, causes the second suction on-off valve to assume the open state, and causes the first suction on-off valve to assume the close state, so that the fuel is sucked into the suction port of the dual-purpose pump from the discharge port side of the fuel pump via the second fuel suction passage.

3. The engine fuel supply system as claimed in claim 1, characterized in that the first on-off valve is opened/closed by a fuel pressure signal.

4. The engine fuel supply system as claimed in claim 2, characterized in that the first on-off valve, the first suction on-off valve, and the second suction on-off valve are opened/closed by a fuel pressure signal.

5. The engine fuel supply system as claimed in claim 1, characterized in that the first on-off valve is opened/closed by an electrical signal.

6. The engine fuel supply system as claimed in claim 2, characterized in that the first on-off valve, the first suction on-off valve, and the second suction on-off valve are opened/closed by an electrical signal.

7. An engine fuel supply system characterized by comprising: a dual-purpose pump serving both for air removal from a cylinder fuel supply passage and for fuel supply into an exhaust pipe; and control means which inhibits fuel supply from the dual-purpose pump into the exhaust pipe during air removal, and inhibits fuel supply from the dual-purpose pump to the cylinder fuel supply passage during fuel supply to the exhaust pipe.

8. An engine fuel supply system comprising a cylinder fuel supply passage for supplying fuel into an engine cylinder by a fuel pump, and an exhaust gas aftertreatment device fuel supply passage for supplying fuel into an engine exhaust gas aftertreatment device, the engine fuel supply system being characterized by comprising:

a dual-purpose pump provided separately from the fuel pump to serve both for air removal from the cylinder fuel supply passage and for fuel supply into the exhaust gas aftertreatment device;

an air-removal fuel supply passage that communicates a discharge port of the dual-purpose pump with the cylinder fuel supply passage;

the exhaust gas aftertreatment device fuel supply passage that communicates the discharge port of the dual-purpose pump with the exhaust gas aftertreatment device;

the first on-off valve provided on the air-removal fuel supply passage for opening/closing the air-removal fuel supply passage;

a second on-off valve provided on the exhaust gas aftertreatment device fuel supply passage for opening/closing the exhaust gas aftertreatment device fuel supply passage; and control means which, when a signal is generated to command air-removal from the cylinder fuel supply passage, activates the dual-purpose pump, causes the first on-off valve to assume an open state, and causes the second on-off calve to assume a close state, so that the fuel is supplied from the dual-purpose pump to the cylinder fuel supply passage via the air-removal fuel supply passage, and which, when a signal is generated to command fuel supply into the exhaust gas aftertreatment device, activates the dual-purpose pump, causes the second on-off valve to assume the open state, and causes the first on-off valve to assume the close state, so that the fuel is supplied from the dual-purpose pump to the exhaust gas aftertreatment device via the exhaust gas aftertreatment device fuel supply passage.

9. An engine fuel supply system characterized by comprising:

a dual-purpose pump serving both for air removal from a cylinder fuel supply passage and for fuel supply into an exhaust gas aftertreatment device; and control means which inhibits fuel supply from the dual-purpose pump into the exhaust gas aftertreatment device during air removal, and inhibits fuel supply from the dual-purpose pump to the cylinder fuel supply passage during fuel supply to the exhaust gas aftertreatment device.

* * * * *